US011322870B2

(12) United States Patent
Yoshida

(10) Patent No.: US 11,322,870 B2
(45) Date of Patent: May 3, 2022

(54) CONNECTOR AND ELECTRONIC DEVICE

(71) Applicant: KYOCERA CORPORATION, Kyoto (JP)

(72) Inventor: Munenobu Yoshida, Yamato (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/978,045

(22) PCT Filed: Feb. 21, 2019

(86) PCT No.: PCT/JP2019/006583
§ 371 (c)(1),
(2) Date: Sep. 3, 2020

(87) PCT Pub. No.: WO2019/171973
PCT Pub. Date: Sep. 12, 2019

(65) Prior Publication Data

US 2020/0412038 A1 Dec. 31, 2020

(30) Foreign Application Priority Data

Mar. 9, 2018 (JP) ..... JP2018-043352

(51) Int. Cl.
*H01R 12/00* (2006.01)
*H01R 12/71* (2011.01)
*H01R 13/631* (2006.01)
*H01R 13/6581* (2011.01)

(52) U.S. Cl.
CPC ..... *H01R 12/716* (2013.01); *H01R 13/6315* (2013.01); *H01R 13/6581* (2013.01)

(58) Field of Classification Search
CPC .... H01R 13/6594; H01R 12/52; H01R 13/41; H01R 12/716; H01R 13/426
USPC ..... 439/74, 676, 607.36
See application file for complete search history.

(56) References Cited

U.S. PATENT DOCUMENTS 6,503,101 B1 * 1/2003 Yu ..... H01R 13/6597 439/607.36
8,888,506 B2 * 11/2014 Nishimura ..... H01R 43/24 439/74
8,986,027 B2 * 3/2015 Nishimura ..... H01R 12/707 439/181
9,300,064 B2 3/2016 Takenaga et al.
9,711,880 B2 7/2017 Kiryu et al.
10,490,958 B2 11/2019 Aoki et al.
(Continued)

FOREIGN PATENT DOCUMENTS

JP 2015135806 A 7/2015
JP 2015176861 A 10/2015
JP 2015228341 A 12/2015

*Primary Examiner* — Abdullah A Riyami
*Assistant Examiner* — Nelson R. Burgos-Guntin
(74) *Attorney, Agent, or Firm* — Duane Morris LLP

(57) ABSTRACT

A connector (10) according to the present disclosure is fitted with a connection object (60). The connector includes a first insulator (20), a second insulator (30) movable relative to the first insulator (20), and one or more contacts (50) mounted to the first insulator (20) and the second insulator (30), wherein the second insulator (30) has a receiving portion (33) that is superimposed on the first insulator (20) from a fitting side in a fitting direction between the connector (10) and the connection object (60).

9 Claims, 14 Drawing Sheets

(56) References Cited

U.S. PATENT DOCUMENTS

2005/0032400 A1* 2/2005 Zhang ..... H01R 12/716 439/74
2005/0042924 A1* 2/2005 Zhang ..... H01R 13/6582 439/607.36
2006/0063432 A1* 3/2006 Chen ..... H01R 13/658 439/607.36
2006/0276061 A1* 12/2006 Koguchi ..... H01R 12/725 439/74
2008/0207014 A1* 8/2008 Takeuchi ..... H01R 12/716 439/74
2008/0305657 A1* 12/2008 Midorikawa ..... H01R 43/0235 439/74
2009/0061655 A1* 3/2009 Miyazaki ..... H01R 12/57 439/74
2010/0068900 A1* 3/2010 Wu ..... H01R 12/716 439/74
2011/0263140 A1* 10/2011 Sato ..... H01R 13/6275 439/74
2013/0012039 A1* 1/2013 Nose ..... H01R 12/716 439/74
2015/0079816 A1* 3/2015 Suzuki ..... H01R 12/7082 439/74
2015/0140840 A1* 5/2015 Nishimura ..... H01R 13/6594 439/74
2015/0140841 A1* 5/2015 Watanabe ..... H01R 43/18 439/74
2015/0207248 A1* 7/2015 Takenaga ..... H01R 13/6582 439/74
2015/0270658 A1 9/2015 Aoki et al.
2016/0190719 A1* 6/2016 Brzezinski ..... H01R 12/73 439/74
2017/0033505 A1* 2/2017 Ozeki ..... H01R 12/716
2017/0141496 A1 5/2017 Kiryu et al.
2020/0044374 A1* 2/2020 Ishida ..... H01R 12/716

* cited by examiner

CONNECTOR AND ELECTRONIC DEVICE

CROSS-REFERENCE TO RELATED APPLICATION

The present application claims priority to and benefit of Japanese Patent Application No. 2018-043352 filed on Mar. 9, 2018, the entire contents of which are incorporated herein by reference.

TECHNICAL FIELD

The present disclosure relates to a connector and an electronic device.

BACKGROUND

As a technique for improving the reliability of connection with a connection object, for example, a connector having a floating structure that absorbs misalignment between circuit boards by moving a part of a connector during and even after fitting is known.

Patent Literature 1 (PTL 1) discloses a connector having a floating structure that shortens a transmission path and is less susceptible to electrical influence from an adjacent contact.

CITATION LIST

Patent Literature

PTL 1: JP2015-176861 (A)

SUMMARY

Solution to Problem

A connector according to an embodiment of the present disclosure is a connector fitted with a connection object, the connector including:

a first insulator;

a second insulator movable relative to the first insulator; and one or more contacts mounted to the first insulator and the second insulator, wherein the second insulator has a receiving portion that is superimposed on the first insulator from a fitting side in a fitting direction between the connector and the connection object.

BRIEF DESCRIPTION OF THE DRAWINGS

In the accompanying drawings:

FIG. 13 is a cross-sectional view taken along the arrows XIII-XIII in

FIG. 3;

DETAILED DESCRIPTION

Figure 1:
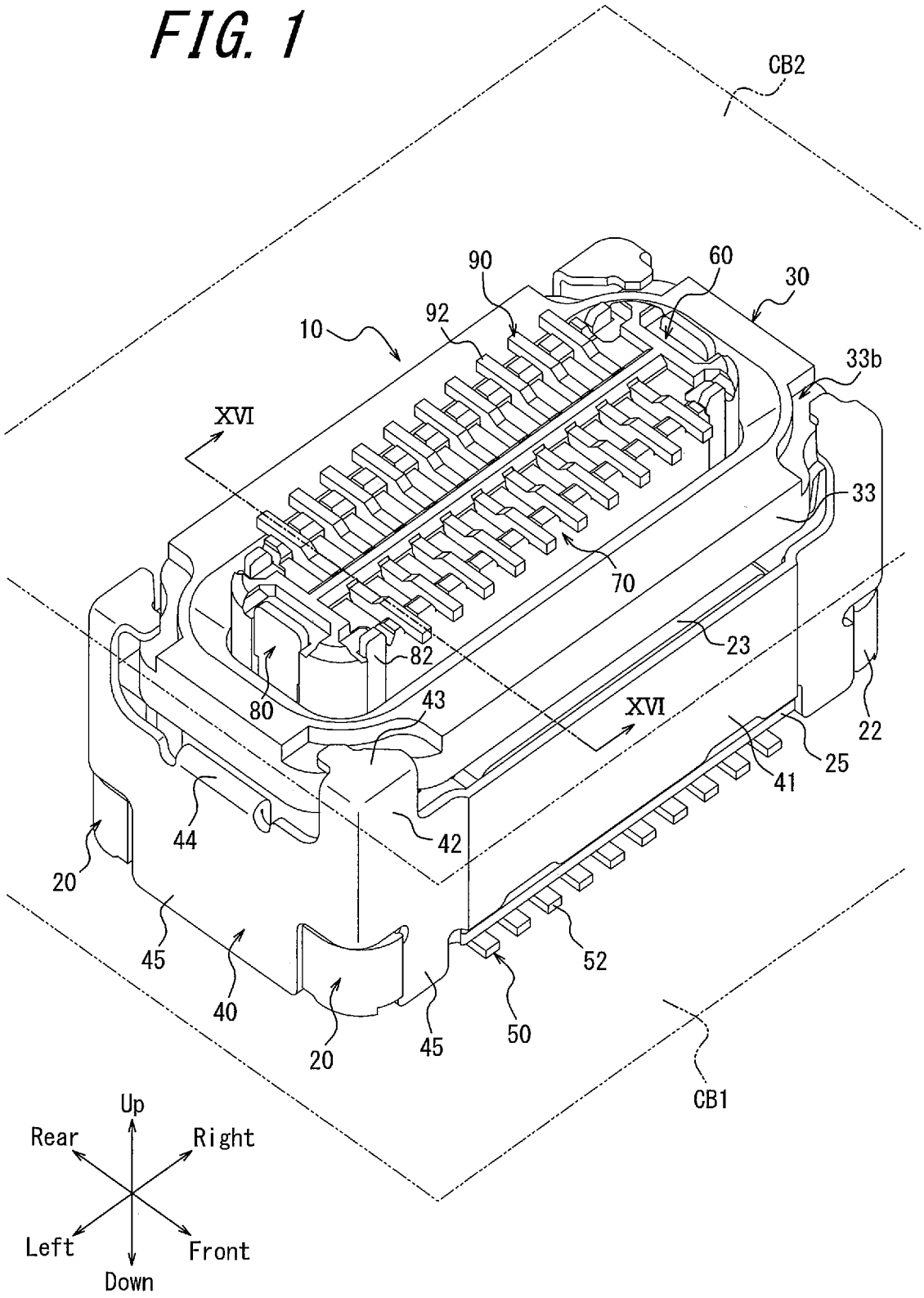
FIG. 1 is an external perspective view illustrating a state where a connector according to an embodiment and a connection object are connected, viewed from top.

In recent years, miniaturization of electronic devices is progressing significantly. Along with this, area saving of a circuit board disposed in the electronic device is progressing. Therefore, for a connector with a floating structure mounted on a circuit board, a design that reduces the mounting area is also required.

A design that corresponds to such miniaturization has not been considered sufficiently for the connector having a floating structure disclosed in PTL 1.

In the case where a connector is miniaturized, the connector strength decreases. In addition, the workability when fitting the connector and a connection object together decreases. More specifically, as a result of miniaturization, the fitting surface between the connector and the connection object becomes smaller, which makes correct positioning during fitting difficult. If the connection object comes into contact with the connector in such a state, the connector with lower strength due to miniaturization is likely to break.

In a connector according to an embodiment of the present disclosure, the strength of the connector and workability at the time of fitting are improved even when the connector having a floating structure is miniaturized.

An embodiment of the present disclosure will be described below with reference to the accompanying drawings. Hereinafter, directions of front-rear, left-right and up-down are based on the respective directions indicated by arrows in the figures. In FIGS. 1 to 13 and 16, the directions of the arrows are consistent in the drawings. The directions of the arrows are consistent in FIGS. 14 and 15. In some drawings, the circuit boards CB1 and CB2 are not illustrated for the sake of simple illustration.

Figure 2:
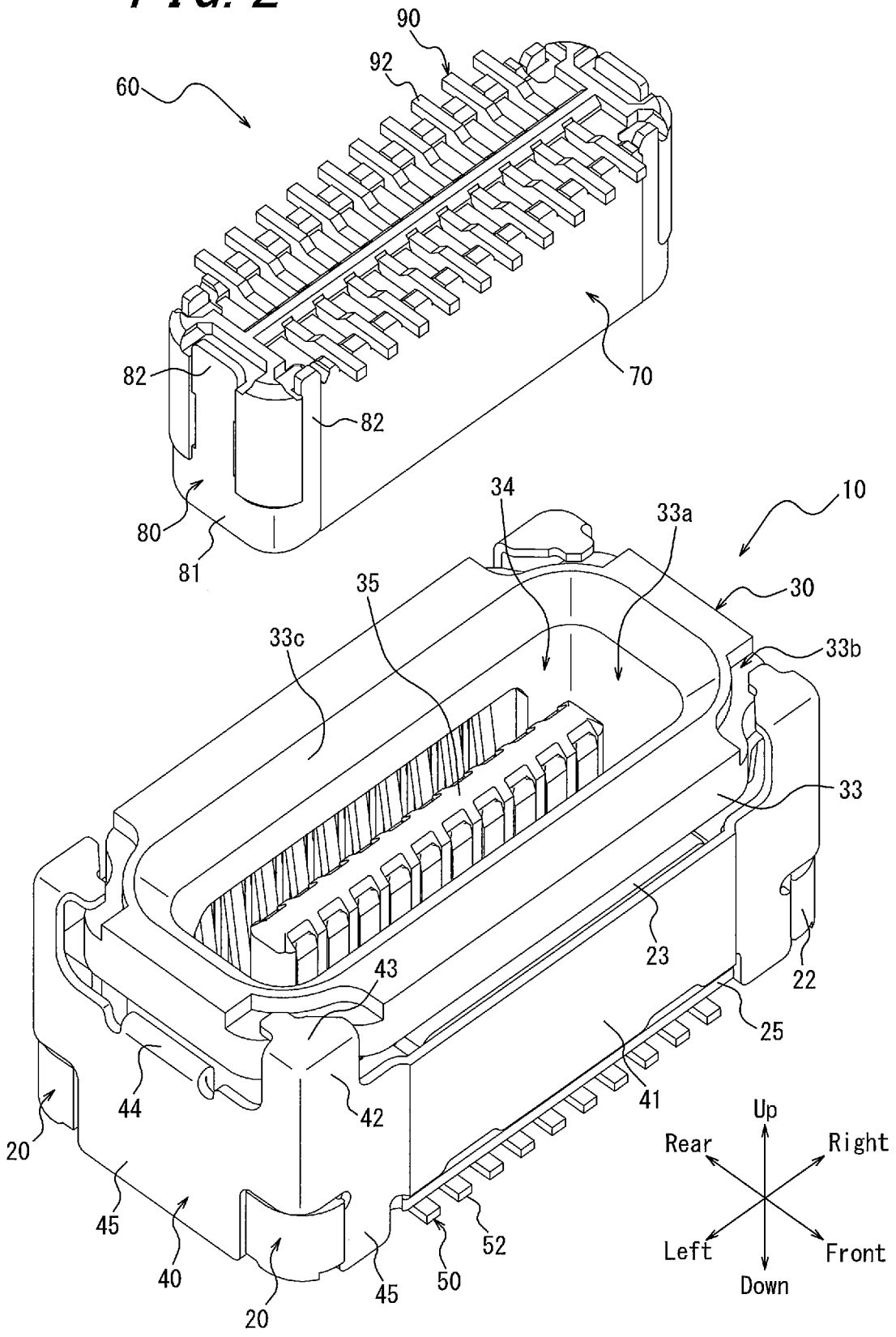
FIG. 2 is an external perspective view illustrating a state where the connector according to an embodiment and the connection object are separated, viewed from top.

FIG. 1 is an external perspective view illustrating a state where a connector 10 according to an embodiment and a connection object 60 are connected, viewed from top. FIG. 2 is an external perspective view illustrating a state where the connector 10 according to an embodiment and the connection object 60 are separated, viewed from top.

In the following description, it is assumed that the connector 10 according to an embodiment is a plug connector and the connection object 60 is a receptacle connector. More specifically, in a connection state where the connector 10 and the connection object 60 are connected to each other, it is assumed that the connector 10 that does not cause contacts 50 to be elastically deformed is a plug connector and the connection object 60 that causes contacts 90 to be elastically deformed is a receptacle connector. The types of the connector 10 and the connection object 60 are not limited thereto. The connector 10 may serve as a receptacle connector and the connection object 60 may serve as a plug connector.

In the following description, it is assumed that the connector 10 and the connection object 60 are mounted on the circuit boards CB1 and CB2, respectively, and as an example, they are connected to them in a vertical direction. More specifically, as an example, the connector 10 and the connection object 60 are connected along the up-down direction. Connection method of the connector 10 and the connection object 60 is not limited thereto. The connector 10 and the connection object 60 may be connected in parallel to the circuit boards CB1 and CB2, respectively, or they may be connected in combination in which one of them is connected in the vertical direction and the other is connected in the parallel direction.

The circuit boards CB1 and CB2 may be rigid boards or any other circuit boards. For example, the circuit board CB1 or CB2 may be a flexible print circuit board (FPC).

The "fitting direction" described in the following description includes the up-down direction, as an example. The "direction substantially orthogonal to the fitting direction" includes, as an example, the front-rear direction, the left-right direction and the directions that approximate these directions. As an example, the "fitting side" includes the upper side. As an example, the "side opposite the fitting side" includes the lower side. As an example, the "fitting surface" includes the top surface of the connector 10. As an example, the "arrangement direction of the contacts 50" includes the left-right direction. As an example, the "direction substantially orthogonal to the arrangement direction of the contacts 50" includes the front-rear direction and the direction that approximates the front-rear direction.

The connector 10 according to an embodiment has a floating structure. The connector 10 allows the connected connection object 60 to move relative to the circuit board CB1. The connection object 60 can move relative to the circuit board CB1 within a predetermined range even when it is connected to the connector 10.

Figure 3:
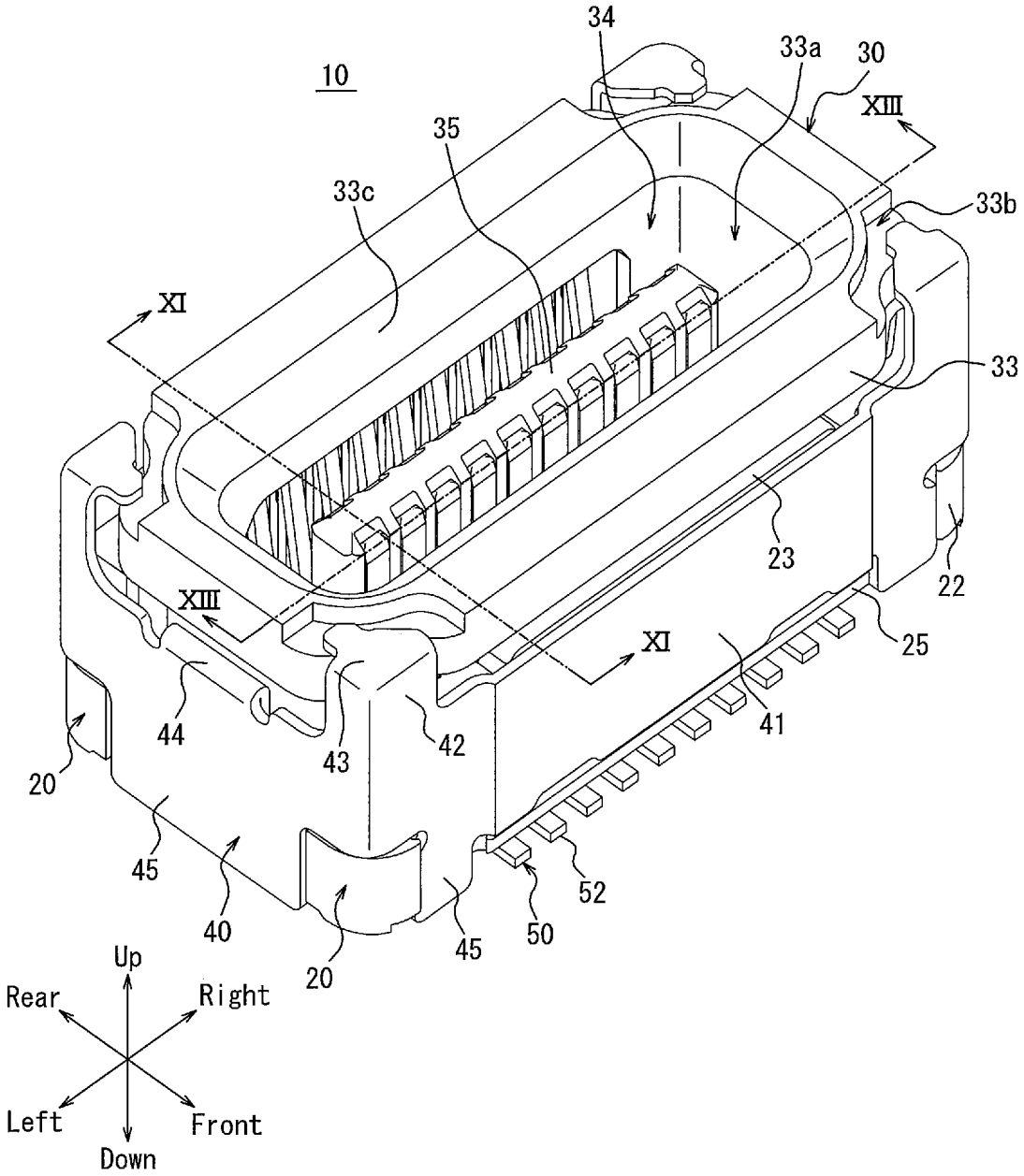
FIG. 3 is an external perspective view illustrating the connector according to an embodiment, viewed from top.
Figure 4:
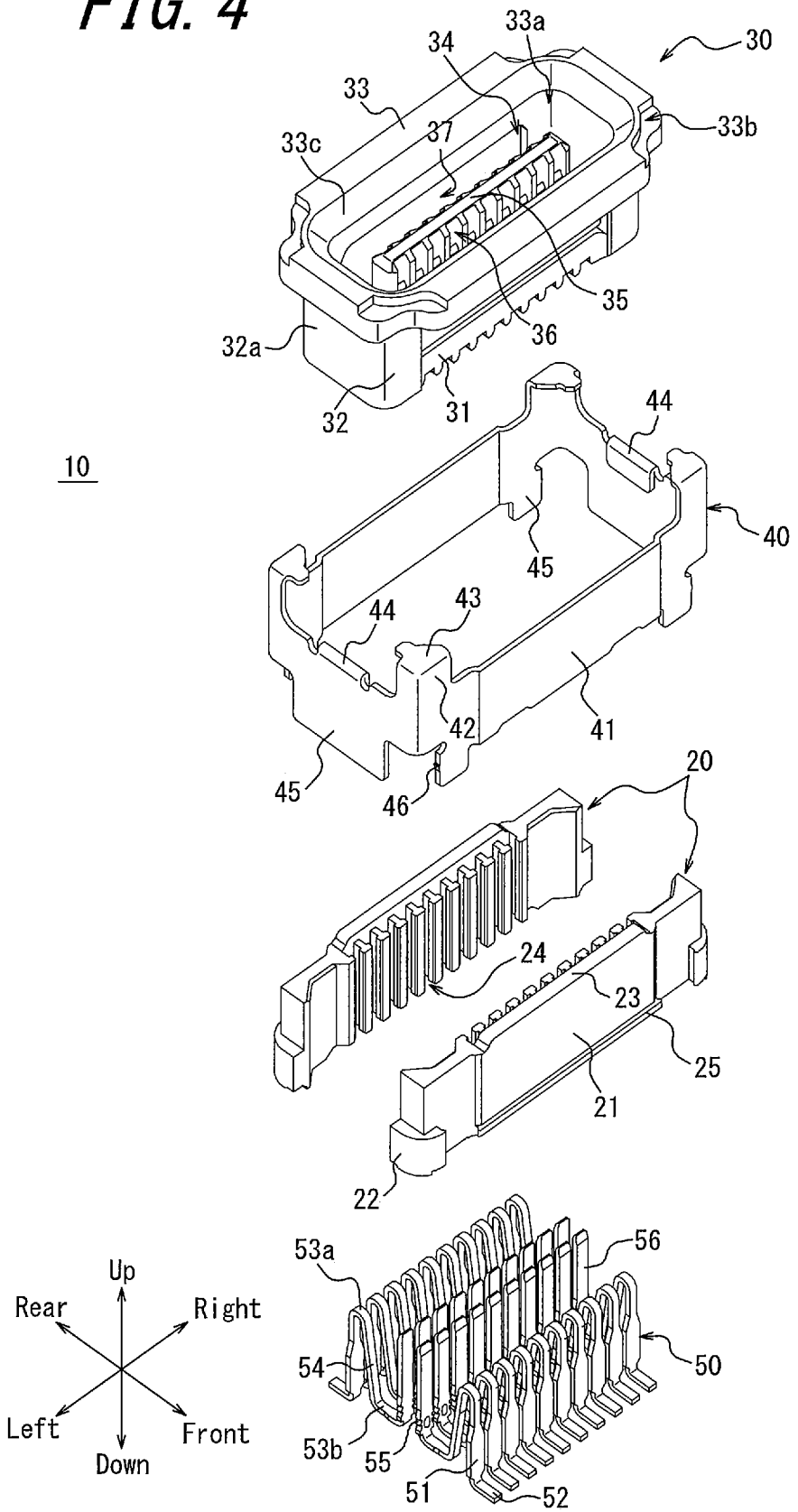
FIG. 4 is an exploded perspective view illustrating the connector in FIG. 3, viewed from top.
Figure 5:
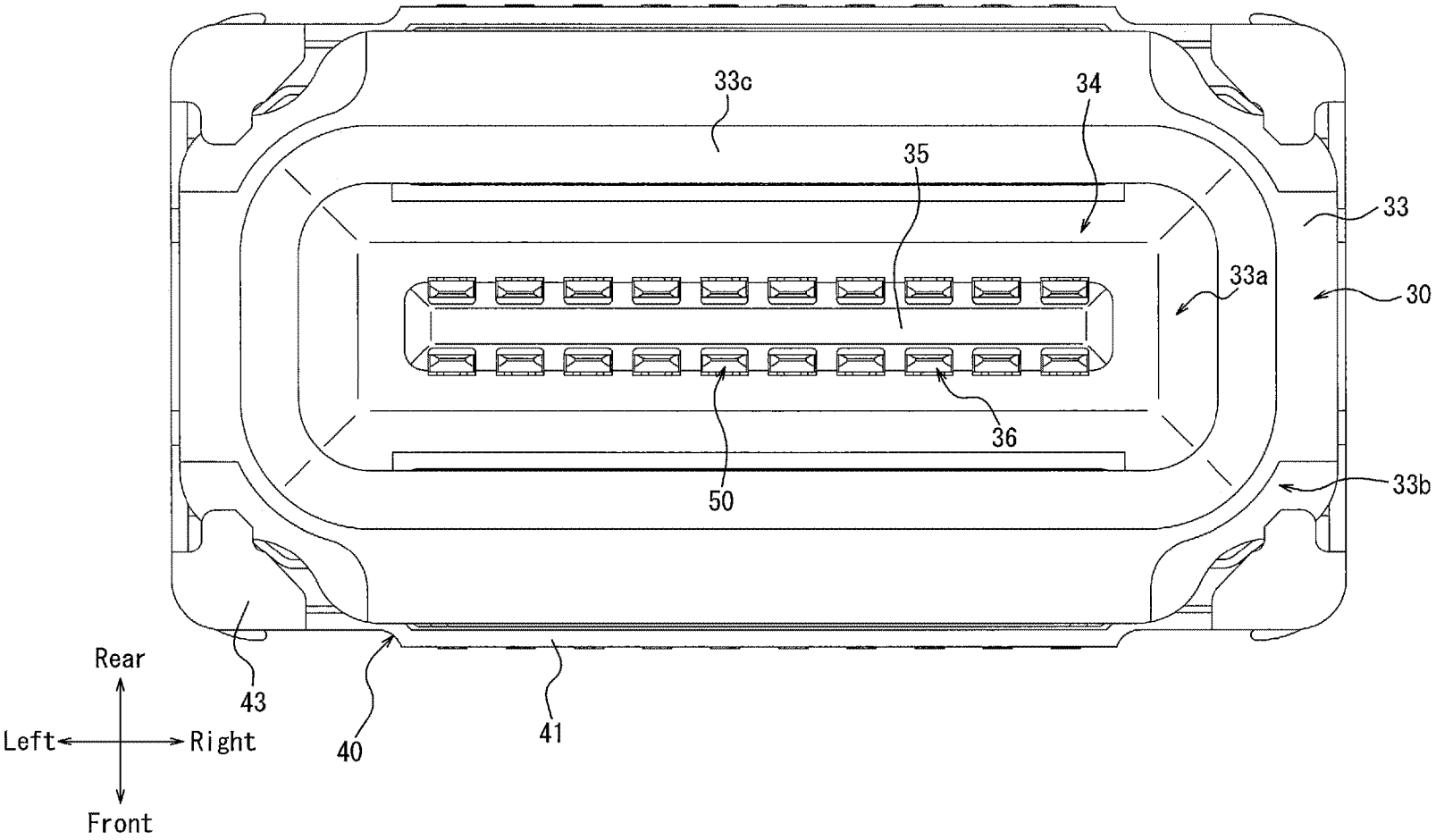
FIG. 5 is a top view of the connector in FIG. 3.
Figure 6:
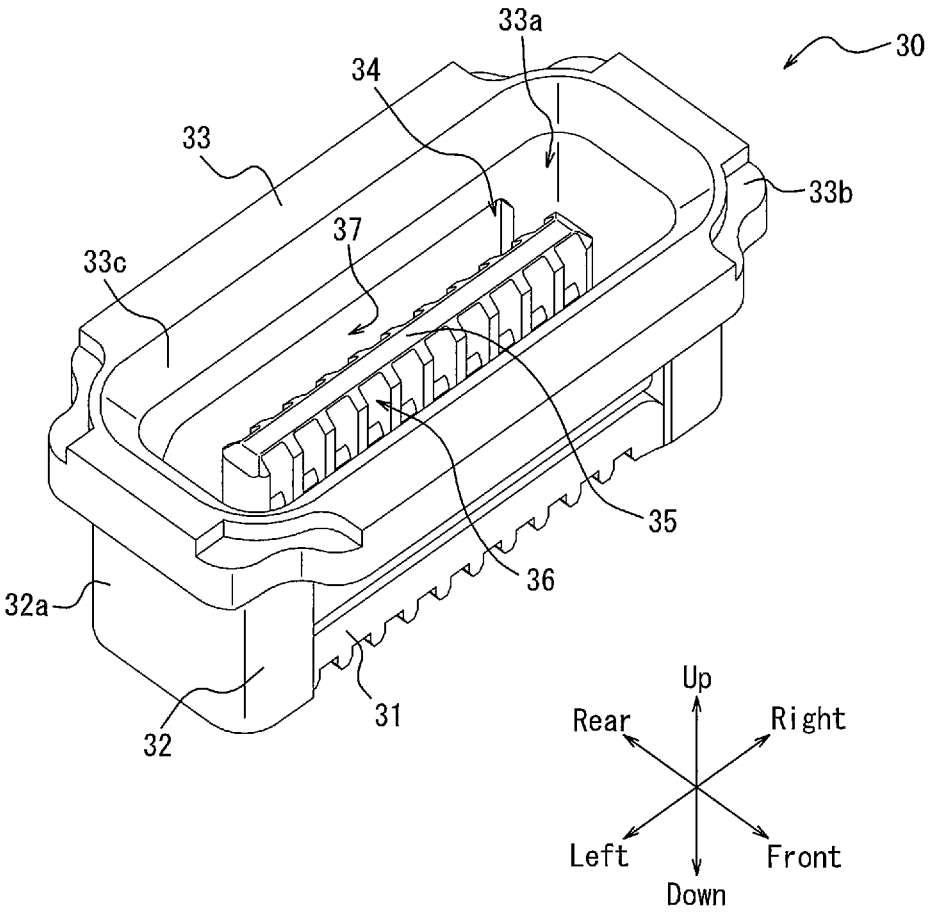
FIG. 6 is an external perspective view illustrating a second insulator alone that constitutes the connector in FIG. 3, viewed from top.
Figure 7:
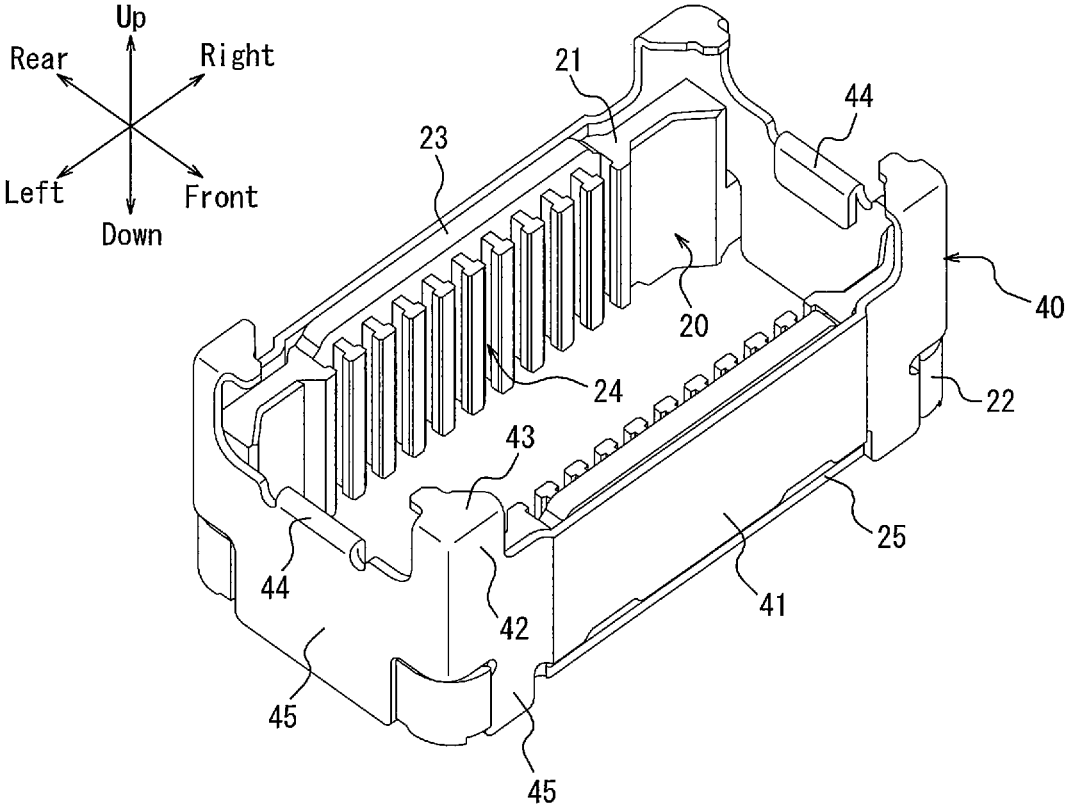
FIG. 7 is an external perspective view illustrating a first insulator and a shielding member constituting the connector in FIG. 3, viewed from top.
Figure 8:
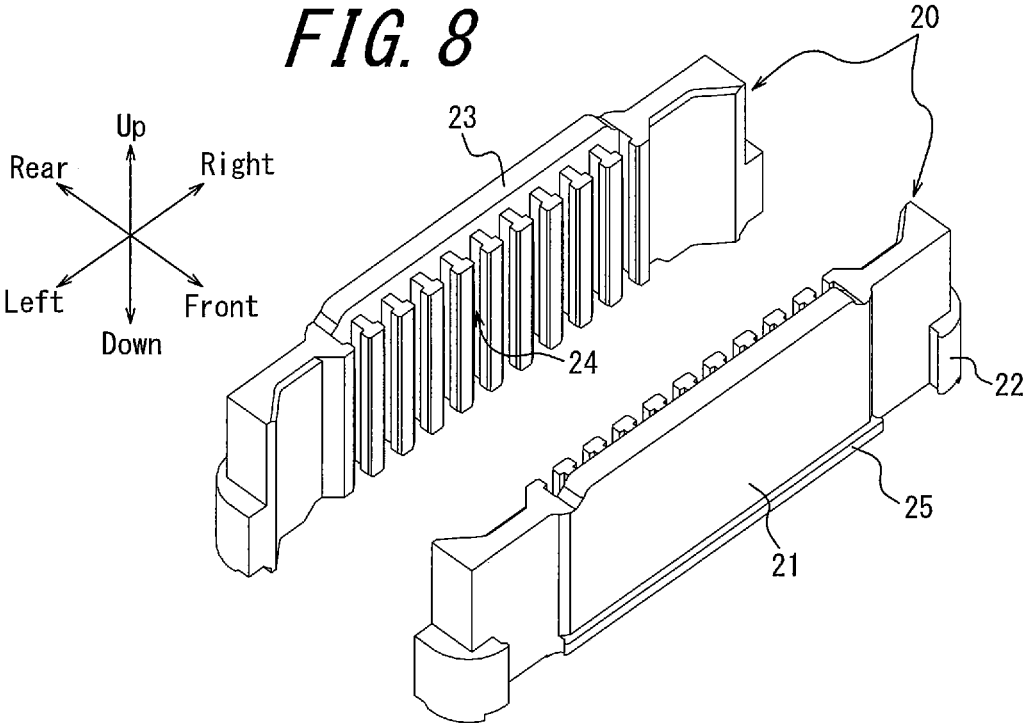
FIG. 8 is an external perspective view illustrating a pair of first insulators in FIG. 7, viewed from top.
Figure 9:
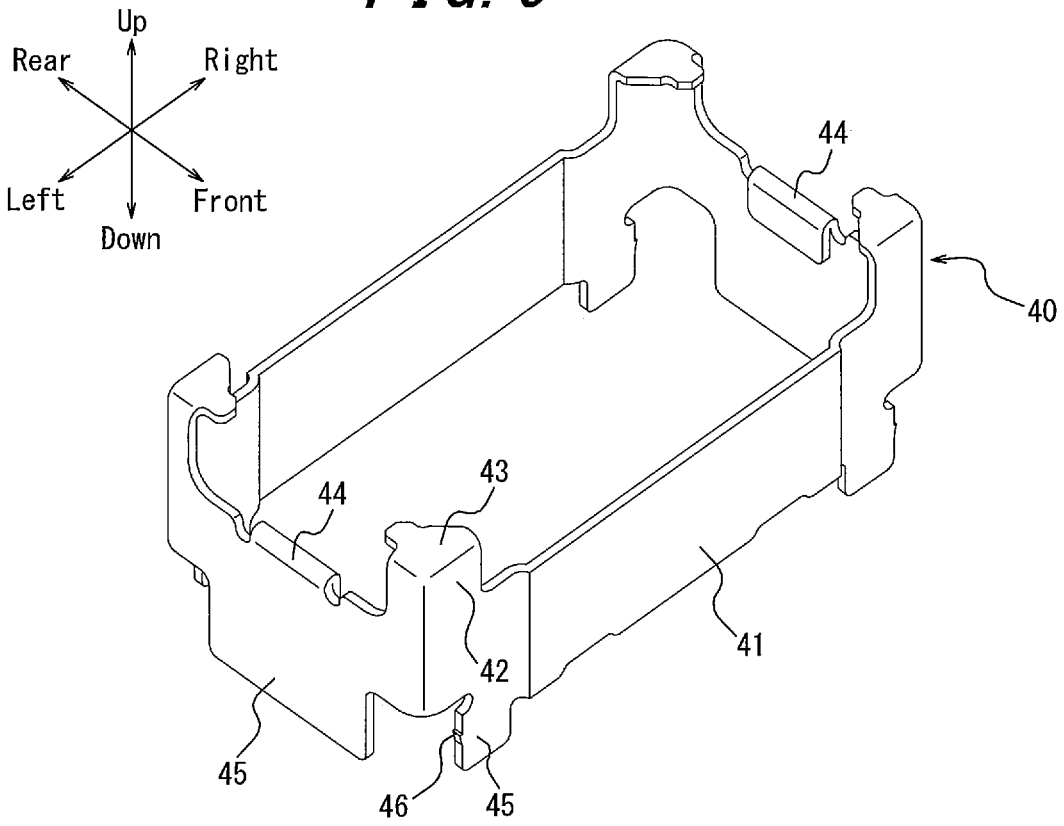
FIG. 9 is an external perspective view illustrating the shielding member in FIG. 7 alone, viewed from top.
Figure 10:
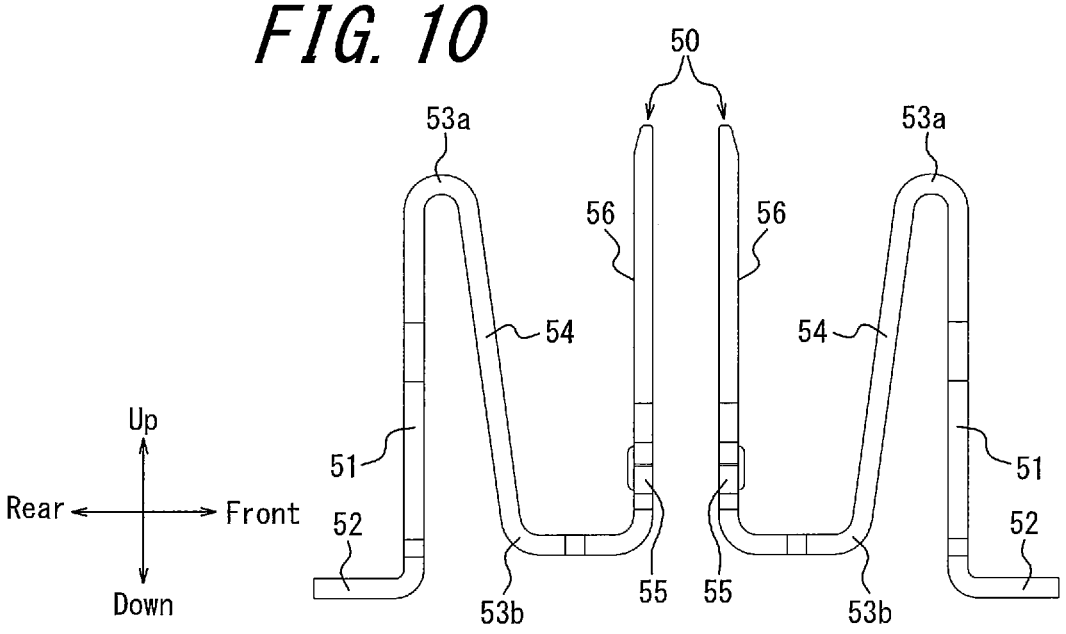
FIG. 10 is a front view illustrating a pair of contacts in FIG. 4.
Figure 11:
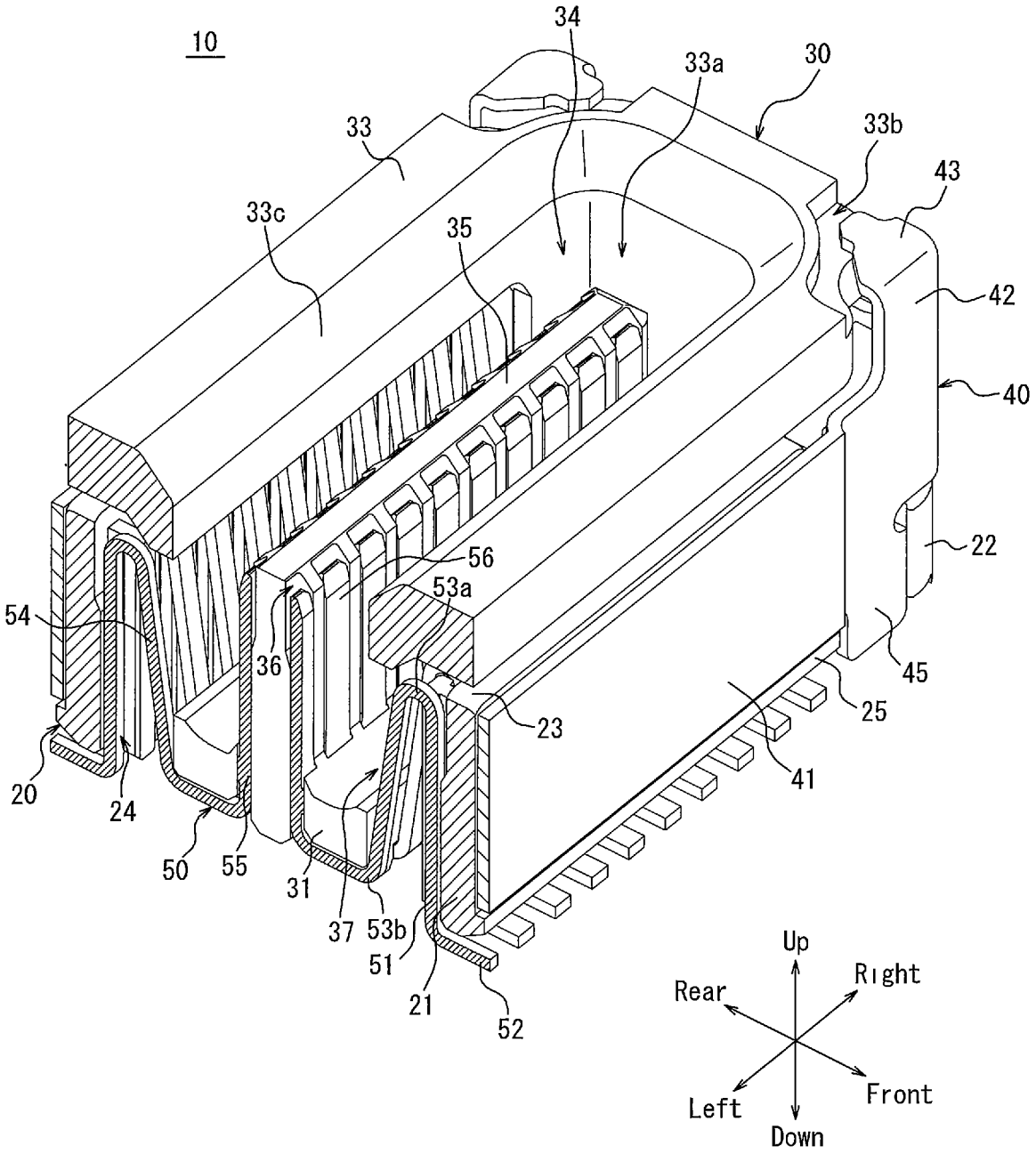
FIG. 11 is a cross-sectional perspective view taken along the arrows XI-XI in FIG. 3.
Figure 12:
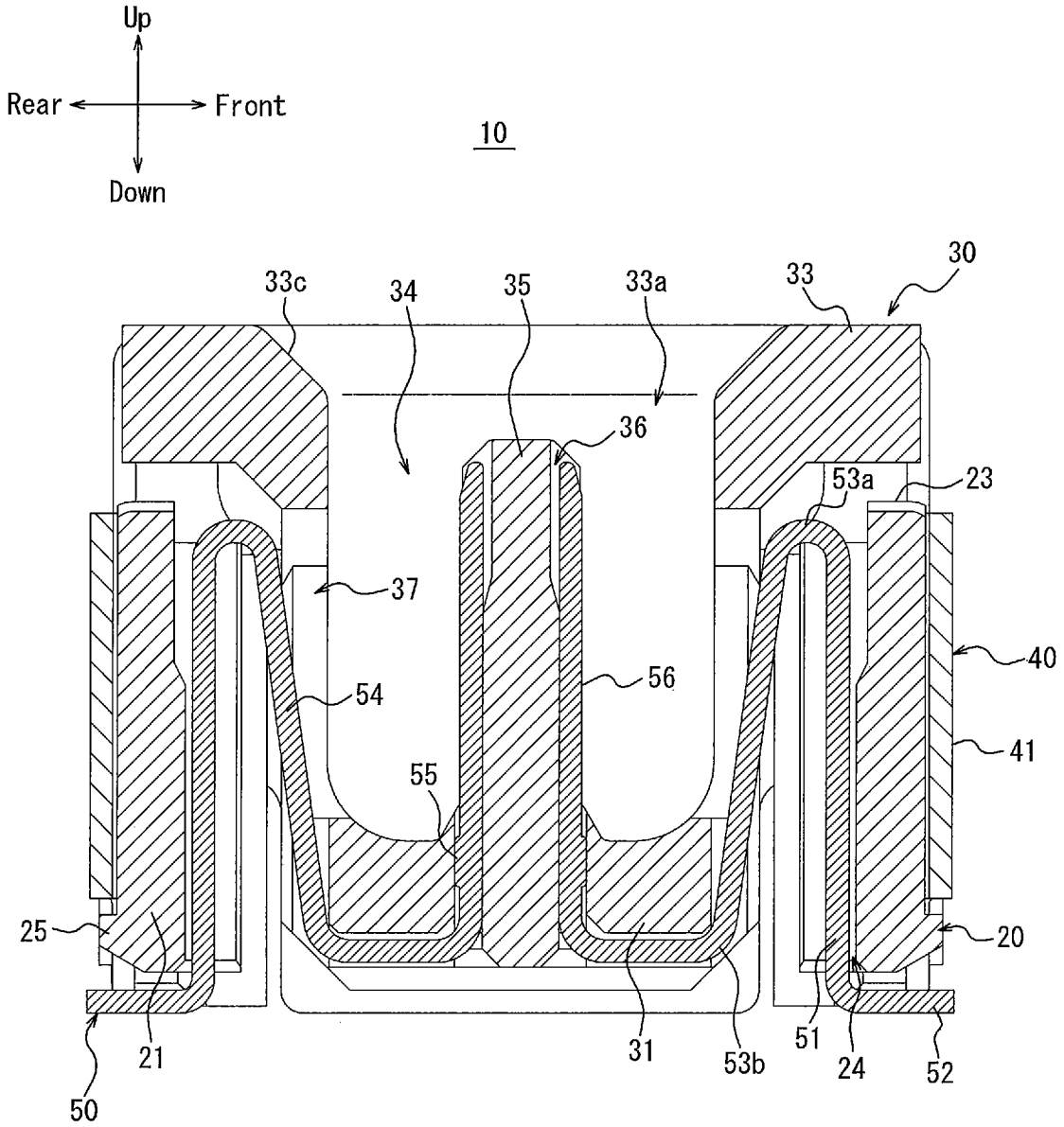
FIG. 12 is a cross-sectional view taken along the arrows XI-XI in FIG. 3.
Figure 13:
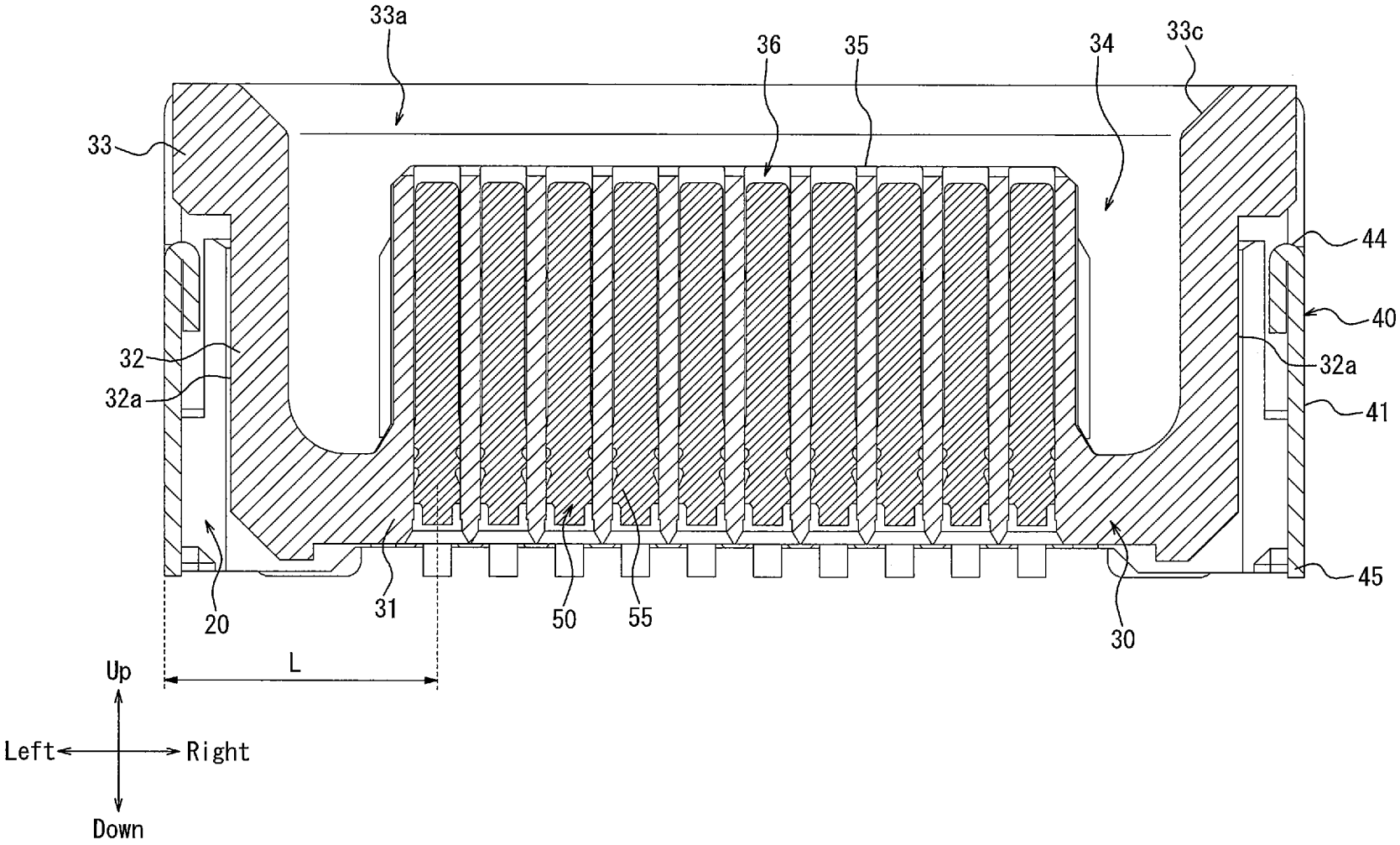

FIG. 3 is an external perspective view illustrating the connector 10 according to an embodiment viewed from top. FIG. 4 is an exploded perspective view illustrating the connector 10 in FIG. 3 viewed from top. FIG. 5 is a top view of the connector 10 in FIG. 3. FIG. 6 is an external perspective view illustrating a second insulator 30 alone that constitutes the connector 10 in FIG. 3. FIG. 7 is an external perspective view illustrating a first insulator 20 and a shielding member 40 constituting the connector 10 in FIG. 3, viewed from top. FIG. 8 is an external perspective view illustrating a pair of first insulators 20 in FIG. 7, viewed from top. FIG. 9 is an external perspective view illustrating the shielding member 40 in FIG. 7 alone, viewed from top. FIG. 10 is a front view illustrating a pair of contacts 50 in FIG. 4. FIG. 11 is a cross-sectional perspective view taken along the arrows XI-XI in FIG. 3. FIG. 12 is a cross-sectional view taken along the arrows XI-XI in FIG. 3, and FIG. 13 is a cross-sectional view taken along the arrows XIII-XIII in FIG. 3.

As illustrated in FIG. 4, as large components, the connector 10 has a pair of first insulators 20, a second insulator 30, a shielding member 40 and a plurality of contacts 50. As an example, the connector 10 is assembled in the following method. The shielding member 40 is press-fitted into a pair of first insulators 20 from above. The second insulator 30 is disposed between the first insulators 20 to which the shielding member 40 is mounted. At this time, with the second insulator 30 inclined in the up-down direction, one of the left and right ends of the second insulator 30 is disposed between the pair of first insulators 20, first. After that, the other end of the second insulator 30 is disposed between the pair of first insulators 20. A plurality of contacts 50 are press-fitted into the second insulator 30 disposed between the pair of first insulators 20 and the pair of first insulators 20 from below.

A detailed configuration of the connector 10 in a state where the contacts 50 are not elastically deformed will be described with mainly reference to FIGS. 3 to 13.

As illustrated in FIGS. 4, 7 and 8, each of the pair of first insulators 20 is a member that is obtained by injection molding an insulating and heat-resistant synthetic resin material and extends lineally in the left-right direction. The pair of first insulators 20 have substantially the same shape. The pair of first insulators 20 are disposed apart from each other in the direction substantially orthogonal to an arrangement direction of the contacts, for example, in the front-rear direction. The pair of first insulators 20 extend substantially in parallel to each other along the arrangement direction of the contacts 50. The pair of first insulators 20 are disposed opposite to each other.

Each first insulator 20 has a side wall 21 extending linearly in the left-right direction. Each first insulator 20 has first regulation portions 22 in a substantially arc shape, protruding outward in the left-right direction and the front-rear direction, from both ends of the side wall 21 in the left-right direction. Each first insulator 20 has a second regulation portion 23 protruding from the upper edge of the side wall 21 toward the fitting side between the connector 10 and the connection object 60. The second regulation portion 23 extends, at the central portion of the side wall 21, in the left-right direction by a predetermined length. More specifically, the second regulation portion 23 extends over the area in the left-right direction in which contact mounting grooves 24 are formed.

Each first insulator 20 has a plurality of contact mounting grooves 24 extending in the inner surface of the side wall 21 along the up-down direction. The contact mounting grooves 24 are recessed side by side in the left-right direction. Each contact 50 is mounted in each contact mounting groove 24.

Each first insulator 20 has a protruding wall 25 protruding, from the end edge on the opposite side to the fitting side between the connector 10 and the connection object 60, to the direction substantially orthogonal to the arrangement direction of the contacts 50. The protruding wall 25 extends in the left-right direction at the lower edge of the outer surface of the side wall 21. More specifically, the protruding wall 25 extends by including all of the area in the left-right direction in which the contact mounting grooves 24 are formed.

As illustrated in FIGS. 4 to 6, the second insulator 30 is a member that is obtained by injection molding an insulating and heat resistant synthetic resin material and extends in the left-right direction. The second insulator 30 is formed such that the fitting side of the connector 10 and the connection object 60 is wider than the opposite side in the four directions of front, rear, left and right. More specifically, the second insulator 30 is formed in a substantially T shape in a front view from the front, a rear view from the rear and a side view from the left-right direction.

The second insulator 30 has a bottom 31 constituting a lower portion, side walls 32 extending upward from both left and right ends of the bottom 31 and a receiving portion 33 connecting, on the fitting side, the side walls 32 on both of the left and right sides.

The receiving portion 33 is formed over at least a part of the entire circumference of the fitting surface between the connector 10 and the connection object 60. For example, the receiving portion 33 is formed over the entire circumference of the fitting surface, that is, over the front-rear direction and the left-right direction. More specifically, the receiving portion 33 is formed in a substantially square shape having an opening 33*a* in the center viewed from the fitting side. The receiving portion 33 protrudes outward from the outer surface of the bottom 31 and the side walls 32 over the entire circumference of front, rear, left and right. Each of four corners 33*b* of the receiving portion 33 is cut out so that the outer edge thereof has a substantially wavy shape, viewed from the fitting side. The receiving portion 33 has a guide portion 33*c* inclined, from the outside toward the inside, to the side opposite to the fitting side, at the inner edge. The guide portion 33*c* is formed over the entire inner circumference of the receiving portion 33, and surrounds the opening 33*a* from the front-rear direction and the left-right direction. The end face of the receiving portion 33 on the fitting side has a flat surface.

The second insulator 30 has a fitting recess 34 formed by the opening 33*a*, side walls 32 on the left and right sides and the bottom 31. The second insulator 30 has a fitting protrusion 35 protruding upward from a substantially center of the bottom 31.

The second insulator 30 has a plurality of contact mounting grooves 36 continuously recessed over the bottom face of front half portion of the bottom 31, inside the front half portion of the bottom 31 and the front face of the fitting protrusion 35. In the same manner, the second insulator 30 has a plurality of contact mounting grooves 36 continuously recessed over the bottom face of rear half portion of the bottom 31, inside the rear half portion of the bottom 31 and the rear face of the fitting protrusion 35. The contact mounting grooves 36 extend along the up-down direction on both of the front and rear faces of the fitting protrusion 35. A plurality of contact mounting grooves 36 are recessed side by side in the left-right direction. Each contact 50 is mounted in each contact mounting groove 36.

The second insulator 30 has an opening 37 on each of the front and rear sides. The opening 37 is surrounded by the bottom 31, a pair of left and right side walls 32 and the receiving portion 33. The width of the opening 37 in the left-right direction is substantially the same as that of the fitting protrusion 35 in the left-right direction in which the contact mounting grooves 36 are formed. In other words, the opening 37 is formed over the entire area in the left-right direction where the contacts 50 are arranged. The contacts 50 mounted to the second insulator 30 are exposed outward from the opening 37.

As illustrated in FIGS. 4, 7 and 9, the shielding member 40 is formed into a shape illustrated in the figures, using any metal material having electric conductivity. The shielding member 40 may be made of metal or may include a resin material and have electric conductivity on the surface layer. The shielding member 40 surrounds the first insulator 20 and the second insulator 30 from the front-rear direction and the left-right direction. More specifically, the shielding member 40 is formed integrally into a substantially square shape viewed from the fitting side between the connector 10 and the connection object 60.

The shielding member 40 has four side faces 41 constituting the outer circumference of front, rear, left and right. The shielding member 40 has four corners 42 each protruding to the fitting side with respect to the side face 41. Each corner 42 is formed into a substantially L-shape viewed from top. The shielding member 40 has extending portions 43 each extending, from the end edge of each corner 42 that protrudes to the fitting side, to the inside direction that is substantially orthogonal to the fitting direction. More specifically, each extending portion 43 extends from the upper end of each corner 42 to the inside over a predetermined area in the front-rear direction and the left-right direction. Each extending portion 43 is located above the corner 33*b* of the second insulator 30 in the up-down direction. More specifically, each corner 33*b* of the second insulator 30 is sandwiched between the extending portion 43 and the first insulator 20 in the up-down direction.

The shielding member 40 has bending portions 44 each protruding from the side face 41 while bending toward the fitting side. More specifically, the bending portions 44 protrude while bending upward in a substantially U-shape from the upper edges of two side faces 41 in the left-right direction, respectively. Each bending portion 44 faces the receiving portion 33 formed at the end portion, of the second insulator 30 in the left-right direction, in the fitting direction between the connector 10 and the connection object 60. The shielding member 40 has six mounting portions 45 extending linearly downward from respective central lower edges of two side faces 41 in the left-right direction and respective lower edges at the left and right ends of two side faces 41 in the front-rear direction. The shielding member 40 has latches 46 each protruding outward from a side edge of each of four mounting portions 45 formed on each side face 41 in the front-rear direction. When each latch 46 is locked to each first regulation portion 22 of the pair of first insulators 20, the shielding member 40 is fixed to the pair of first insulators 20. In this case, when a portion protruding from the first insulator 20 comes in contact with the shielding member 40, the first regulation portion 22 prevents the shielding member 40 from excessively moving downward when press-fitted.

As illustrated in FIGS. 4, 7 and 13, the first insulator 20 is not interposed between at least a part of each end face 32*a* of the second insulator 30 in the arrangement direction of the contacts 50 and the shielding member 40. For example, the first insulator 20 is not interposed between each entire end face 32*a* of the second insulator 30 and the shielding member 40. More specifically, when the second insulator 30 is disposed between the pair of first insulators 20, both end faces 32*a* of the second insulator 30 in the left-right direction face two side faces 41 of the shielding member 40 in the left-right direction, respectively, without the first insulator 20 being interposed therebetween. In this manner, each end of the pair of first insulators 20 in the left-right direction is connected to each other by the shielding member 40, and each end of the connector 10 in the left-right direction is formed by each side face 41 of the shielding member 40.

As illustrated in FIG. 7, in the fitting direction between the connector 10 and the connection object 60, end edges of the first insulator 20 are located closer to the fitting side than the end edges of the side faces 41 of the shielding member 40. More specifically, the upper edge of each second regulation portion 23 of the first insulator 20 is located above the upper edge of each side face 41 of the shielding member 40. In this manner, each second regulation portion 23 of the first insulator 20 protrudes further upward above the upper edge of each side face 41 of the shielding member 40.

Each of two side faces 41 of the shielding member 40 in the front-rear direction is located closer to the fitting side than each protruding wall 25. More specifically, each side face 41 of the shielding member 40 in the front-rear direction is located above each protruding wall 25 over the protruding wall 25 extending in the left-right direction.

As illustrated in FIGS. 5 and 7, the first insulator 20 is disposed inside the shielding member 40. More specifically, the side walls 21, the second regulation portions 23, the contact mounting grooves 24 and the protruding wall 25*s* of the first insulator 20 are located inside the shielding member 40 in the front-rear direction and the left-right direction. Only the outer end of each first regulation portion 22 of the first insulator 20 in the front-rear direction slightly protrudes outwardly from the shielding member 40 in the front-rear direction. In this manner, entire first insulator 20 excepting only a part of each first regulation portion 22 is accommodated inside the shielding member 40.

As illustrated in FIGS. 4 and 10 to 12, each contact 50 is obtained by molding a thin plate made of copper alloy with spring elasticity such as, for example, phosphor bronze, beryllium copper, or titanium copper, or Corson copper alloy by using a progressive die (stamping) into the shape illustrated in the figures. Each contact 50 is formed of a metal material having a small elastic coefficient so that a change in shape due to elastic deformation will be large. A surface of each contact 50 is treated with nickel plating as an undercoat and then plated with gold or tin.

As illustrated in FIG. 4, the contacts 50 are arranged in rows along the left-right direction. The contacts 50 are mounted to the first insulator 20 and the second insulator 30. As illustrated in FIGS. 10 to 12, a pair of contacts 50 arranged at the same left and right positions are formed and arranged symmetrically along the front-rear direction. More specifically, a pair of contacts 50 are formed and arranged so as to be substantially line-symmetric with respect to the up-down axis passing through the center therebetween.

As illustrated in FIG. 4, each contact 50 has a first latch 51 extending along the up-down direction and formed wider than the other adjacent portions of each contact 50. The first latch 51 is locked to the first insulator 20. At this time, as illustrated in FIGS. 11 and 12, each first latch 51 is accommodated in each contact mounting groove 24 of the first insulator 20. Each contact 50 has a mounting portion 52 that extends outward in a substantially L shape from the lower end of the first latch 51.

Each contact 50 has an elastically deformable first elastic portion 53*a* extending upward while bending from the upper end of the first latch 51. The first elastic portion 53*a* linearly extends upward from the first latch 51, then bends in a substantially U shape, and linearly extends obliquely downward from the outside to the inside. Each contact 50 has a connecting portion 54 that is formed continuously with the first elastic portion 53*a*, and linearly extends obliquely downward from the outside to the inside. Each contact 50 has a second elastic portion 53*b* that is formed continuously with the connecting portion 54 and is elastically deformable. The second elastic portion 53*b* linearly extends obliquely downward from the lower end of the connecting portion 54 to the inside, then bends and linearly extends inside in the front-rear direction.

Each contact 50 has a second latch 55 extending in a substantially L shape from the inner end of the second elastic portion 53*b*. The second latch 55 linearly extends from the second elastic portion 53*b* to the inside in the front-rear direction, then bends at a substantially right angle, and linearly extends to the fitting side along the up-down direction. Compared with the second elastic portion 53*b*, the second latch 55 is formed wider in the left-right direction. The second latch 55 is locked to the second insulator 30. At this time, the second latch 55 is accommodated in the contact mounting groove 36 of the second insulator 30. Each contact 50 has a contact portion 56 that is formed by the outer surface of the second latch 55 in the front-rear direction, and comes in contact with a contact 90 of the connection object 60, in a fitting state where the connector 10 and the connection object 60 are fitted together. The contact portion 56 is exposed outward in the front-rear direction from the contact mounting groove 36 of the second insulator 30.

In the connector 10 configured in the above described manner, the mounting portion 52 of each contact 50 is soldered to a circuit pattern formed on the mounting surface of the circuit board CB1. Each mounting portion 45 of the shielding member 40 is soldered to a ground pattern or the like formed on the mounting surface. In this manner, the connector 10 is mounted on the circuit board CB1. On the mounting surface of the circuit board CB1, electronic components different from the connector 10 including, for example, a CPU, a controller, a memory, etc. are mounted.

A structure of the connection object 60 will be described with reference mainly to FIGS. 14 and 15.

Figure 14:
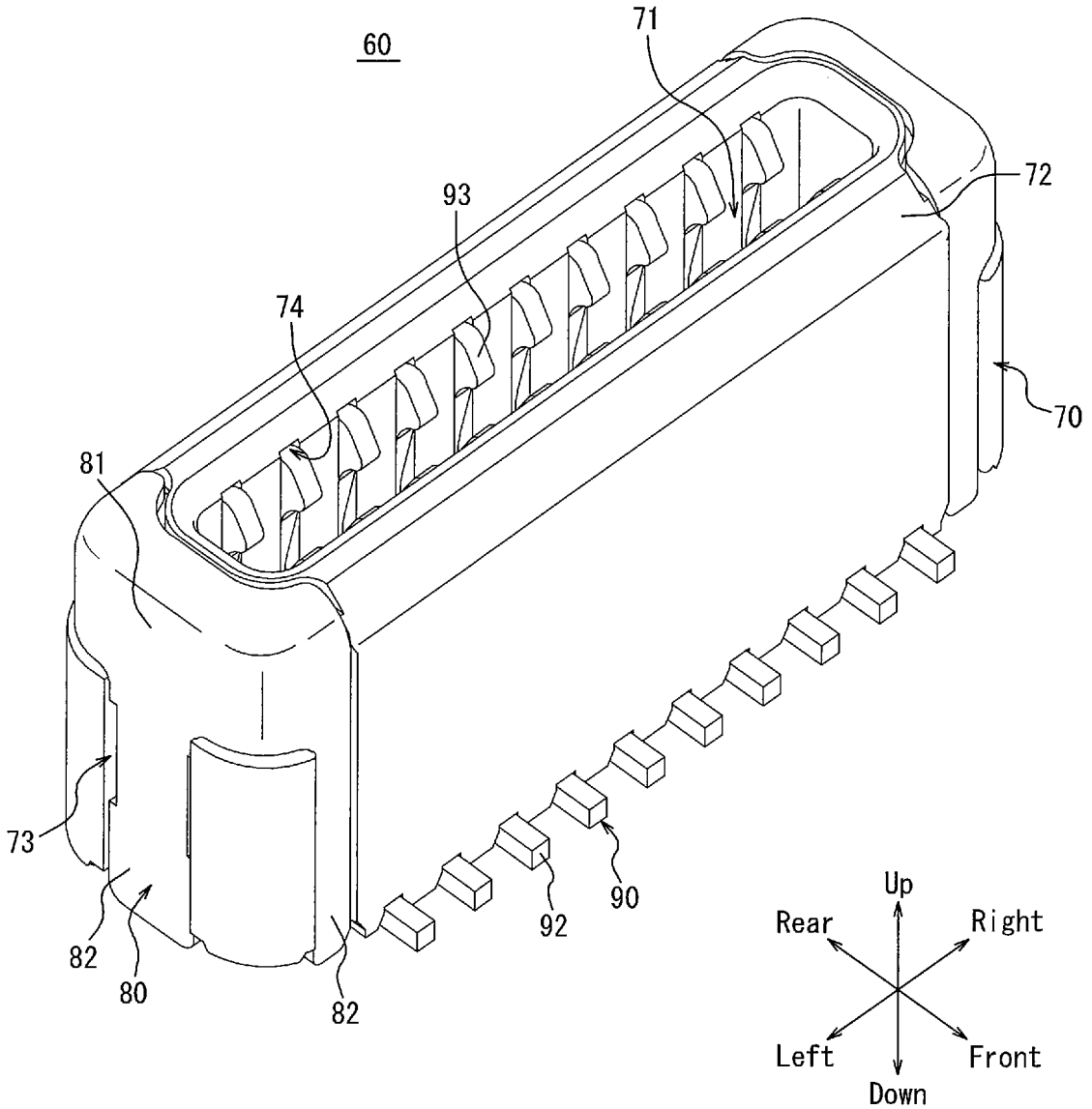
FIG. 14 is an external perspective view illustrating a connection object to be connected to the connector in FIG. 3, viewed from top.

FIG. 14 is an external perspective view illustrating the connection object 60 connected to the connector 10 in FIG. 3, viewed from top. FIG. 15 is an exploded perspective view illustrating the connection object 60 in FIG. 14, viewed from top.

Figure 15:
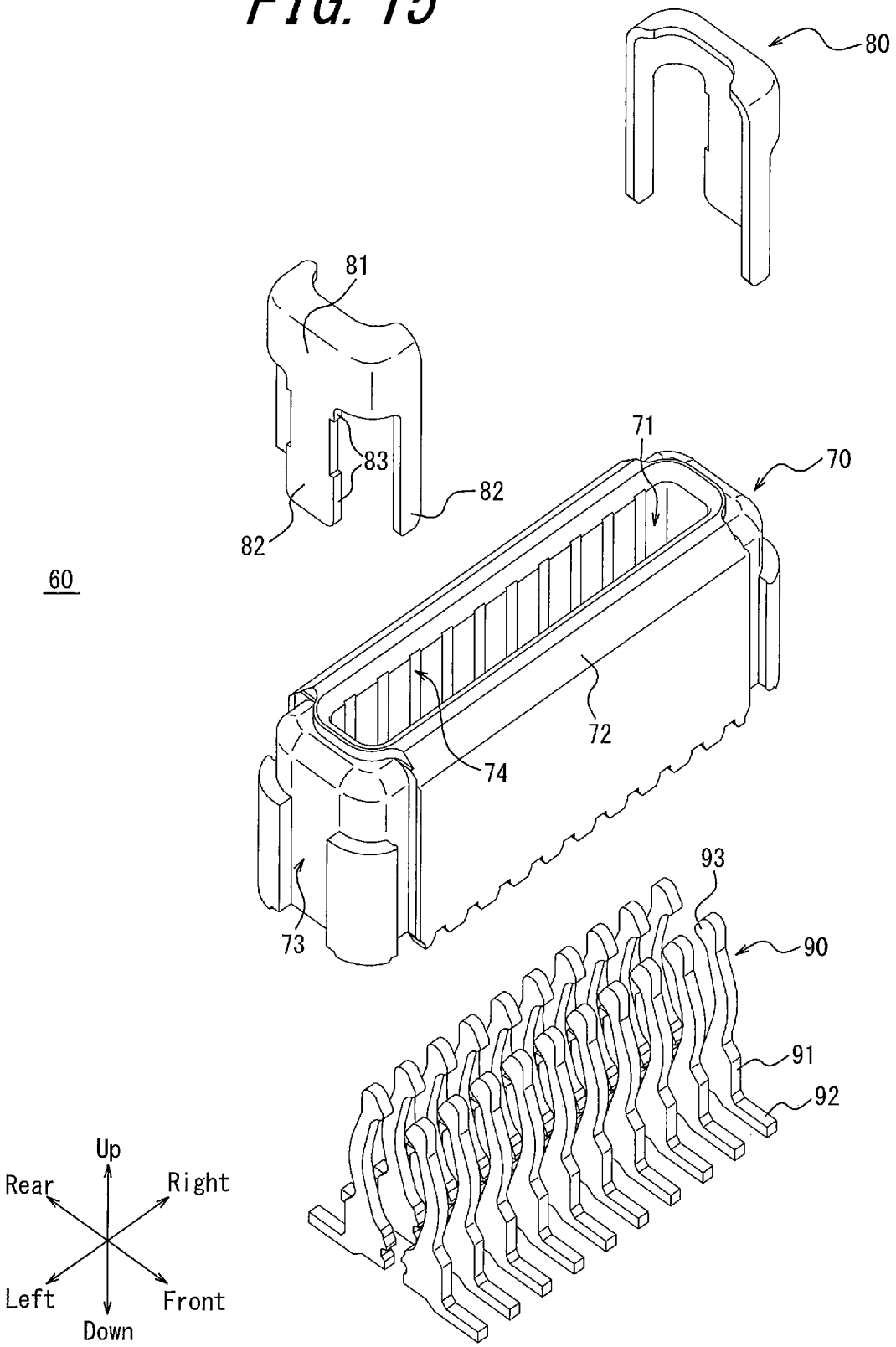
FIG. 15 is an exploded perspective view illustrating the connection object in FIG. 14, viewed from top.

As illustrated in FIG. 15, the connection object 60 has, as large components, insulators 70, metal fittings 80 and contacts 90. As an example, the connection object 60 is assembled by press-fitting each metal fitting 80 into each insulator 70 from above and press-fitting each contact 90 from below.

The insulator 70 is a substantially quadrangular prismatic member formed by injection molding an insulating and heat-resistant synthetic resin material. The insulator 70 has fitting recesses 71 each formed on the upper surface. The insulator 70 has a guide portion 72 formed so as to surround the fitting recesses 71 over the upper edge of the fitting recesses 71. The guide portion 72 is formed by an inclined surface that inclines outward from the upper side to the lower side at the upper edge of the fitting recesses 71. The insulator 70 has metal fitting attachments 73 formed over substantially the entire left and right side faces. The metal fittings 80 are mounted to the metal fitting attachments 73 from above.

The insulator 70 has a plurality of contact mounting grooves 74 that are continuously recessed over the front half portion of the bottom face and the front inner surface of the fitting recesses 71. Similarly, the insulator 70 has a plurality of contact mounting grooves 74 that are continuously recessed over the rear half of the bottom face and the inner surface on the rear side of the fitting recesses 71. The contact mounting grooves 74 are provided along the up-down direction on both of the front and rear inner surfaces of the fitting recesses 71. The contact mounting grooves 74 are recessed side by side along the left-right direction. Each contacts 90 is mounted in each contact mounting groove.

The metal fitting 80 is formed into a shape illustrated in the figure by using any metal material. The metal fitting 80 is arranged at each of the left and right ends of the insulator 70. The metal fitting 80 has a base 81 that forms the upper portion thereof and is formed in a substantially U shape in a top view. The metal fitting 80 has three mounting portions 82 linearly extending downward from the lower edge of the base 81. More specifically, each mounting portion 82 extends downward from three positions, that is, each lower edge on both of the front and rear sides of the base 81 and the lower edge of the base 81 along the left-right direction. The metal fitting 80 has latches 83 each provided at the upper end and the lower portion of the mounting portion 82 that extends from the lower edge of the base 81 along the left-right direction and formed wider than the central portion. The metal fitting 80 is fixed to the insulator 70 by locking the latch 83 to the metal fitting attachment 73 of the insulator 70.

Each contact 90 is obtained by molding a thin plate made of copper alloy with spring elasticity such as, for example, phosphor bronze, beryllium copper, or titanium copper, or Corson copper alloy by using a progressive die (stamping) into the shape illustrated in the figures. A surface of each contact 90 is treated with nickel plating as an undercoat and then plated with gold or tin.

The contacts 90 are arranged in rows along the left-right direction. Each contact 90 has a latch 91 formed wider than other portions. Each latch 91 is locked to each contact mounting groove 74 of the insulator 70. Each contact 90 has a mounting portion 92 linearly extending outward from the lower end of the latch 91. Each contact 90 has an elastic contact portion 93 extending upward in a curved manner from the upper end of the latch 91. The tip of each elastic contact portion 93 comes in contact with the contact portion 56 of each contact 50 of the connector 10 in a fitting state where the connector 10 and the connection object 60 are fitted together. Each elastic contact portion 93 is elastically deformable along the front-rear direction.

In the connection object 60 configured in the above described manner, the mounting portion 92 of each contact 90 is soldered to a circuit pattern formed on the mounting surface of the circuit board CB2. The mounting portion 82 of the metal fitting 80 is soldered to a ground pattern or the like formed on the mounting surface. In this manner, the connection object 60 is mounted on the circuit board CB2. On the mounting surface of the circuit board CB2, electronic components different from the connection object 60 including, for example, a camera module, a sensor, etc. are mounted.

Figure 16:
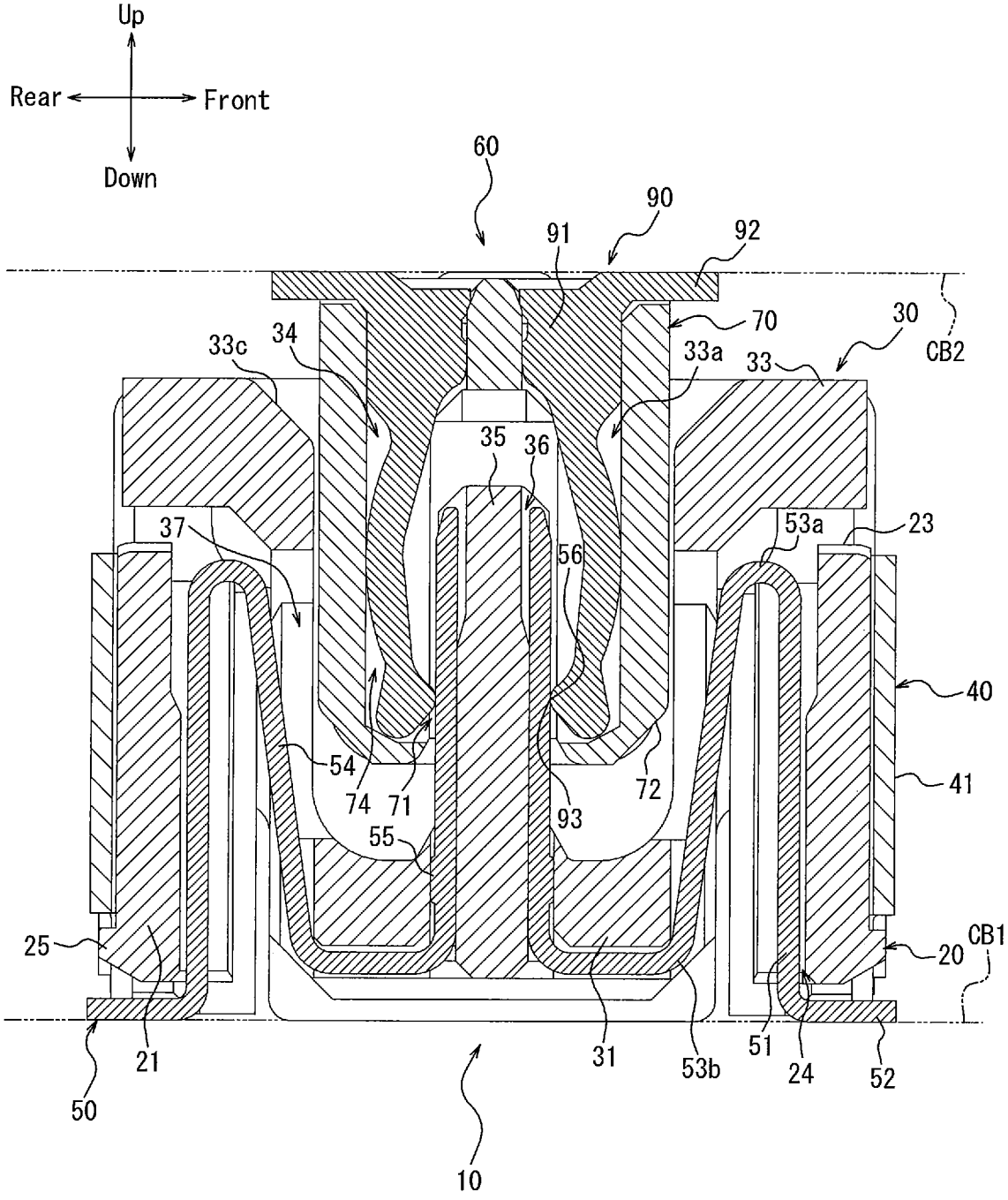
FIG. 16 is a cross-sectional view taken along the arrows XVI-XVI in FIG. 1.

FIG. 16 is a cross-sectional view taken from the arrow XVI-XVI in FIG. 1.

An operation of the connector 10 having a floating structure when connecting the connection object 60 to the connector 10 will be described with reference mainly to FIG. 16.

As illustrated also in FIGS. 11 and 12, the contacts 50 of the connector 10 located between a pair of first insulators 20 support the second insulator 30 in a state where the second insulator 30 is separated from the first insulator 20 and is floating. At this time, the lower portion of the second insulator 30 excluding the receiving portion 33 is located between the pair of first insulators 20. The receiving portion 33 is superimposed on the end of the first insulator 20, from the fitting side, in the fitting direction of the connector 10 and the connection object 60. More specifically, as illustrated also in FIG. 5, the receiving portion 33 is located closer to the fitting side than the pair of the first insulators 20, and covers a part of the side wall 21 excluding a part of the left and right ends, when viewed from the fitting side. The receiving portion 33 is superimposed on the ends of the pair of first insulators 20 in the left-right direction. In addition, the receiving portion 33 is superimposed on the ends of the pair of first insulators 20 in the front-rear direction. At this time, the receiving portion 33 is located closer to the fitting side than the side faces 41 of the shielding member 40 in the front-rear direction and the left-right direction. More specifically, the receiving portion 33 is located closer to the fitting side than the upper edge of each of the side faces 41 at the front, rear, right, and left.

The first insulator 20 is fixed to the circuit board CB1 by soldering the mounting portions 52 of the contacts 50 to the circuit board CB1. The second insulator 30 is movable relative to the fixed first insulator 20 when the first elastic portions 53*a* and the second elastic portions 53*b* of contacts 50 elastically are deformed.

At this time, the side faces 41 of the shielding member 40 in the left-right direction, more specifically, at least one of the bending portion 44 and the extending portion 43 prevents the second insulator 30 from excessively moving in the left-right direction relative to the first insulator 20. When the second insulator 30 largely moves in the left-right direction beyond the design value, due to the elastic deformation of the contacts 50, at least one of the side wall 32 and the receiving portion 33 of the second insulator 30 comes in contact with at least one of the bending portion 44 and the extending portion of the shielding member 40. In this manner, the second insulator 30 does not move to outside in the left-right direction any more.

Similarly, both the left and right ends of the side wall 21 of the first insulator 20 prevents the second insulator 30 from excessively moving relative to the first insulator 20 in the front-rear direction. When the second insulator 30 largely moves beyond the design value in the front-rear direction, due to the elastic deformation of the contacts 50, the side wall 32 of the second insulator 30 comes in contact with both left and right ends of the side wall 21 of the first insulator 20. In this manner, the second insulator 30 does not move to outside in the front-rear direction any more.

As illustrated also in FIG. 2, with the connection object 60 upside down with respect to the connector 10 having such a floating structure, the connector 10 and the connection object 60 are faced to each other in the up-down direction while substantially aligning the front-rear position and the left-right position thereof. After that, the connection object 60 is moved downward. At this time, even if they are slightly misaligned to each other in the front-rear direction and in the left-right direction, for example, the connection object 60 comes in contact with the receiving portion 33 of the second insulator 30. Since the guide portion 33*c* is formed on the connector 10 side and the guide portion 72 is formed on the connection object 60 side, the floating structure of the connector 10 allows the second insulator 30 to move relative to the first insulator 20. In this manner, the connection object 60 is guided into the fitting recess 34 of the second insulator 30.

When the connection object 60 is further moved downward, as illustrated in FIG. 16, the fitting protrusion 35 of the connector 10 fits with the fitting recess 71 of the connection object 60. With the second insulator 30 of the connector 10 fitted with the insulator 70 of the connection object 60, the contact portion 56 of the contact 50 and the elastic contact portion 93 of the contact 90 are in contact with each other. At this time, the elastic contact portion 93 of the contact 90 slightly elastically deforms outward inside the contact mounting groove 74.

When the connection object 60 is pushed downward with respect to the connector 10, for example, the friction force between the contact portion 56 of the contact 50 and the elastic contact portion 93 of the contact 90 causes the second insulator 30 to move downward with respect to the first insulator 20. In such a case, at least one of the second regulation portion 23 of the first insulator 20 and the bending portion 44 of the shielding member 40 regulates excessive downward movement of the second insulator 30 with respect to the first insulator 20. When the second insulator 30 moves significantly downward beyond the design value, due to elastic deformation of the contact 50, the receiving portion 33 of the second insulator 30 comes in contact with at least one of the second regulation portion 23 of the first insulator 20 and the bending portion 44 of the shielding member 40. In this manner, the second insulator 30 does not move downward any more.

In this manner, the connector 10 and the connection object 60 are completely connected to each other. At this time, the circuit board CB1 and the circuit board CB2 are electrically connected to each other via the contact 50 and the contact 90.

In this state, a pair of elastic contact portions 93 of the contact 90 clamp a pair of contacts 50 of the connector 10 from both front and rear sides by the inward elastic force along the front-rear direction. Due to the reaction to the pressing force on the contact 50 thus caused, when the connection object 60 is removed from the connector 10, the second insulator 30 receives an upward force via the contact 50. In this manner, even if the second insulator 30 moves upward, the extending portion 43 of the shielding member 40 prevents the second insulator 30 from coming out upward with respect to the first insulator 20. As illustrated in FIG. 5, each extending portion 43 of the shielding member 40 is superimposed on the receiving portion 33 of the second insulator 30 in a top view. More specifically, each extending portion 43 is superimposed on each corner 33*b* of the receiving portion 33. Therefore, when the second insulator 30 moves upward, each extending portion 43 extending inward from each corner 42 comes in contact with each corner 33*b*. In this manner, the second insulator 30 does not move upward any more.

The connector 10 according to an embodiment as described above is miniaturized even if it has a floating structure. Since the first insulator 20 is not interposed between the shielding member 40 and at least a part of the end face 32*a* of the second insulator 30 in the left-right direction, the connector 10 is miniaturized in the longitudinal direction, more specifically, in the left-right direction. More specifically, as illustrated in FIG. 13, the distance L from the outer surface of the connector 10 in the longitudinal direction to the contact 50 disposed on the outermost side is shorten. Since the first insulator 20 is not interposed between the entire end face 32*a* of the second insulator 30 and the shielding member 40, the connector 10 exhibits the effect of miniaturization more remarkably.

In the connector 10, the transmission characteristics are improved even in a large-capacity and high-speed signal transmission. More specifically, when the shielding member 40 having an electrical conductivity is mounted to the first insulator 20, the influence of noise on the transmission signal is reduced. For example, since the shielding member 40 suppresses noise such as magnetism that flows into the connector 10 from outside, the electrical disturbance of the signal transmitted by the contact 50 is reduced. Conversely, since the shielding member 40 suppresses noise such as magnetism that flows from the connector 10 to outside, the electrical influence of the signals transmitted by the contact 50 on the electronic components mounted around the connector 10 is reduced.

Since the shielding member 40 surrounds the first insulator 20 and the second insulator 30, the influence of noise on the transmission signal is reduced over the entire circumference of the front, back, left and right of the connector 10. Therefore, the transmission characteristics in signal transmission are further improved. When a part of the contact 50 is exposed like the connector 10, the shielding member 40 surrounds the entire circumference of the connector 10, so that the effect of improving the transmission characteristics becomes more remarkable.

Since the corner 42 of the shielding member 40 projects to the fitting side with respect to the side face 41 of the shielding member 40, the movement of the second insulator 30 in the up-down direction is allowed between the upper end of the corner 42 and the upper end of the side face 41.

At this time, since the shielding member 40 has the extending portion 43, excessive upward movement of the second insulator 30 is regulated. Therefore, damage to each component of the connector 10 caused by excessive movement of the second insulator 30 beyond the design value is suppressed. In this manner, the reliability of the connector 10 as a product is improved.

Since the shielding member 40 has the mounting portions 45 formed at the ends in the left-right direction, the surface area of each end is increased. Therefore, the strength of the ends is improved. In this manner, even if the second insulator 30 moves excessively and comes in contact with the end portion, damage or deformation of the shielding member 40 is suppressed.

Since the upper edge of the first insulator 20 is located above the upper edge of the side face 41 of the shielding member 40, even if the second insulator 30 is pushed downward, the receiving portion 33 of the second insulator 30 comes in contact with the first insulator 20 made of resin. The first insulator 20 prevents the second insulator 30 from being scraped due to contact thereof with the upper edge of the side face 41 of the shielding member 40 made of metal. Therefore, even if the second insulator 30 moves downward due to the floating structure, the reliability of the connector 10 as a product is improved.

Since at least one of the second regulation portion 23 of the first insulator 20 and the bending portion 44 of the shielding member 40 comes in contact with the second insulator 30, excessive downward pushing of the second insulator 30 is regulated. Since the second insulator 30 comes in contact with the bending portion 44 of the shielding member 40, bend of the bending portion 44 facing the receiving portion 33 prevents damage such as scraping of the second insulator 30 by the shielding member 40 made of metal. Furthermore, a bend of a part of the shielding member 40 can improve the strength of the shielding member 40. Since the bending portion 44 faces the receiving portion 33 formed in the second insulator 30 in the fitting direction, the connector 10 exhibits the above described effect more remarkably.

Since a pair of first insulators 20 are arranged, as separate components, apart from each other in the front-rear direction, the connector 10 can contribute to miniaturization even if the connector 10 has a floating structure. More specifically, since the first insulator 20 is not formed at both ends of the connector 10 in the left-right direction, the connector 10 is miniaturized in the longitudinal direction. The distance L from the outer surface of the connector 10 in the longitudinal direction to the contact 50 disposed on the outermost side is shortened. In addition, since the first insulator 20 is arranged as two components in the front-rear direction, the same pair of first insulators 20 can be used as it is even if the dimensions of the connector 10 in the lateral direction, more specifically, in the front-rear direction, are changed due to a design change. In this case, it is only necessary to change the arrangement interval of the same pair of first insulators 20 in the front-rear direction without newly manufacturing the first insulator 20 in response to a design change. Therefore, the productivity of the connector 10 is improved.

Since a pair of first insulators 20 are mounted to the shielding member 40 and extend substantially parallel to each other along the left-right direction, the width of the connector 10 in the lateral direction becomes substantially uniform over the longitudinal direction. As a result thereof, the width of each contact 50 in the lateral direction becomes substantially the same, each contact 50 being arranged along the longitudinal direction. Therefore, the productivity of each component constituting the connector 10 is improved, and as a result, the productivity of the entire connector 10 is improved.

Since the pair of first insulators 20 have substantially the same shape, it is not necessary to manufacture a first insulator 20 having a different shape, and it is only necessary to manufacture a plurality of first insulators 20 having the same shape. More specifically, when the dimension of the connector 10 in the front-rear direction is changed, a mold for molding the first insulator 20 is required each time. However, by arranging the first insulators 20 at a distance in the front-rear direction and making them the same shape, a pair of first insulators 20 can freely correspond to the dimension of the connector 10 in the front-rear direction, which no longer requires manufacture of a new mold. Therefore, manufacture of a pair of first insulators 20 is facilitated, and the productivity of the connector 10 is further improved.

The ends of a pair of first insulators 20 in the left-right direction are connected to each other by the shielding member 40, which facilitates the positioning of the pair of first insulators 20. Furthermore, when the contact 50 is press-fitted into the first insulator 20 from below, the first insulator 20 is fixed by the shielding member 40, thus the contact 50 is easily press-fitted. Therefore, the manufacture of the connector 10 is facilitated and its productivity is improved.

Since the first insulator 20 is disposed inside the shielding member 40, the sizes of the connector 10 in the front-rear direction and the left-right direction are substantially the same as those of the shielding member 40. In this manner, since all of the components other than the shielding member 40 of the connector 10 are arranged inside the shielding member 40, the connector 10 can be miniaturized.

Since the first insulator 20 has the first regulation portion 22, excessive downward movement of the shielding member 40 that occurs when the shielding member 40 is press-fitted from above is regulated. Therefore, it is easy to mount the shielding member 40 to the first insulator 20, and the productivity of the connector 10 is improved.

As illustrated in FIG. 3, since the first insulator 20 has the protruding wall 25, the insulating first insulator 20 is interposed between the lower edge of the side face 41 of the shielding member 40 and the mounting portion 52 of the contact 50. This facilitates electrical insulation between the shielding member 40 and the contact 50. In addition, as with the first regulation portion 22, an excessive downward movement of the shielding member 40 that occurs when the shielding member 40 is press-fitted from above is regulated. Therefore, it is easy to attach the shielding member 40 to the first insulator 20, and the productivity of the connector 10 is improved.

Since the second insulator 30 has the receiving portion 33 that is superimposed on the upper end of the first insulator 20 from the fitting side, the strength of the connector is improved even when the connector 10 having a floating structure is miniaturized. More specifically, since the strength of the second insulator 30 is increased due to the thickness of the receiving portion 33, the connector strength of the entire connector 10 is also increased. In addition, even when the connector 10 having a floating structure is miniaturized, workability at the time of fitting is improved. More specifically, even if the position of the connection object 60 is displaced from the correct position when fitting with the connector 10, the tip of the connection object 60 easily comes in contact with the receiving portion 33 first. Since the connector 10 has also a floating structure, when the connection object 60 comes in contact with the receiving portion 33, the second insulator 30 moves relative to the first insulator 20, and fitting between the connector 10 and the connection object 60 is realized. In this manner, the synergistic effect of the receiving portion 33 and the floating structure allows the connector 10 and the connection object 60 to be fitted together easily. This suppresses damage to the connector 10. For example, in a top view, since a gap between the first insulator 20 and the second insulator 30 is covered by the receiving portion 33, a situation is avoided where the connection object 60 gets into the gap therebetween and is caught, resulting in damage to the connector 10. Furthermore, since the gap becomes smaller, entering of foreign matters from outside is suppressed. Therefore, when the connector 10 and the connection object 60 are connected to each other, the possibility that external foreign matters may come in contact with the contact 50 to cause conduction failure and a short circuit between the contacts 50 can be suppressed.

Since the receiving portion 33 is formed over the entire circumference of the fitting surface, the connector 10 exerts the above-described effect regarding the connector strength and workability at the time of fitting more remarkably. For example, since the receiving portion 33 covers the gap between the first insulator 20 and the second insulator 30 in the front-rear and left-right directions, the workability in fitting is improved in the front-rear and left-right directions.

Since the corner 33*b* of the receiving portion 33 is cut out, contact with the shielding member 40 when the second insulator 30 moves is suppressed. Therefore, the movable amount of the second insulator 30 with respect to the first insulator 20 is increased. As a result, the connector 10 and the connection object 60 can be fitted together more easily.

Since the receiving portion 33 is located closer to the fitting side than the side face 41 of the shielding member 40, a gap is formed between the receiving portion 33 and the side face 41 of the shielding member 40. Thus, when the second insulator 30 moves downward, the side face 41 of the shielding member 40 does not hinder the movement. Therefore, the movable amount of the second insulator 30 is maintained.

Since the lower portion of the second insulator 30 is formed to be narrower than the receiving portion 33, the movable amount of the second insulator 30 with respect to the first insulator 20 is increased. As a result, the connector 10 and the connection object 60 can be fitted together more easily.

Since the receiving portion 33 has the guide portion 33*c* that inclines, from the outside to the inside, toward the opposite side from the fitting side at the inner edge, the connection object 60 is easily guided into to the fitting recess 34 of the second insulator 30. Therefore, the connector 10 and the connection object 60 can be fitted together more easily.

Since the end face on the fitting side of the receiving portion 33 is flat, the connection object 60 can slide on the surface of the receiving portion 33 when the connector 10 and the connection object 60 are fitted together. Therefore, the connector 10 and the connection object 60 can be fitted together more easily.

When the second insulator 30 moves, the elastically deformed contact 50 is accepted by the opening 37 of the second insulator 30. Thus, the connector 10 can be miniaturized in the lateral direction while maintaining the movable amount of the second insulator 30 necessary for the floating operation.

Since the shielding member 40 is press-fitted into the first insulator 20 and the mounting portion 45 is soldered to the circuit board CB1, the shielding member 40 can stably fix the first insulator 20 to the circuit board CB1. The shielding member 40 improves the mounting strength of the first insulator 20 to the circuit board CB1.

Since the contact 50 is made of a metal material having a small elastic coefficient, the connector 10 can secure the required movement amount of the second insulator 30 even when the force applied to the second insulator 30 is small. The second insulator 30 can move smoothly with respect to the first insulator 20. In this manner, the connector 10 can easily absorb the misalignment when fitted with the connection object 60. In the connector 10, the elastic part of each contact 50 absorbs the vibration generated by some external factor. This suppresses the possibility that a large force is applied to the mounting portion 52. Therefore, damage to the part connected with the circuit board CB1 is suppressed. Crack generation in the solder at the portion connecting the circuit board CB1 and the mounting portion 52 can be prevented. Therefore, the connection reliability is improved even when the connector 10 and the connection object 60 are connected to each other.

It will be apparent to those skilled in the art that the present disclosure can be implemented in other specific forms than the above-described embodiments without departing from the spirit or the essential characteristics thereof. Therefore, the above description is exemplary and not limited thereto. The scope of the disclosure is defined by the appended claims rather than by the preceding description. Of all changes, some changes which fall within the scope of their equivalents are to be included therein.

For example, the shape, the arrangement, the orientation, the number, and the like of each of the above-described components are not limited to the contents described above and illustrated in the drawings. The shape, the arrangement, the orientation, the number, and the like of each component may be configured in any manner as long as the function can be realized.

The method of assembling the connector 10 and the connection object 60 described above is not limited to the contents described above. The method of assembling the connector 10 and the connection object 60 may be any method as long as they can be assembled so that their respective functions are exhibited. For example, the shielding member 40 or the contact 50 may be integrally formed with the first insulator 20 or the second insulator 30 by insert molding instead of press fitting.

The pair of first insulators 20 have been described as being formed as separate components, but are not limited thereto. For example, in a state in which the lower ends of the right and left ends of the pair of side walls 21 are connected together along the right-left direction, the first insulator 20 may be integrally formed in a substantially U-shape in a side view in the right-left direction.

The first insulator 20 has been described as being composed of two parts, but it is not limited thereto. The first insulator 20 may be composed of two or more parts.

Although all of the first insulator 20, except for only a small part of the first regulation portion 22, has been described as being accommodated inside the shielding member 40, it is not limited thereto. As for the first insulator 20, the entire first regulation portion 22 is also disposed inside the shielding member 40, and all the component parts thereof may be accommodated inside the shielding member 40.

Although the receiving portion 33 has been described as covering the side wall 21 expect for a part of the left and right ends thereof when viewed from the fitting side, it is not limited thereto. The receiving portion 33 may cover the entire side wall 21 or cover the entire first insulator 20 including the side wall 21 from the fitting side.

The receiving portion 33 may not be formed over the entire circumference of the fitting surface. The receiving portion 33 may be formed in any shape as long as the workability when fitting the connector 10 and the connection object 60 together can be maintained. For example, the receiving portion 33 may be formed along only the longitudinal direction of the connector 10.

The top surface of the receiving portion 33 needs not be flat. For example, in the top surface of the receiving portion 33, a recess or a through hole that engages with a protrusion formed on the connection object 60 may be formed.

The receiving portion 33 may not be a part of the second insulator 30. The receiving portion 33 and the second insulator 30 may be formed as separate components. At this time, the receiving portion 33 may be mounted onto the second insulator 30 by any method including any adhesion method such as an adhesive or any locking method such as a combination of convex and concave.

The second insulator 30 may have no opening 37 or may have any recess instead of the opening 37 as long as the connector 10 can be miniaturized in the lateral direction while maintaining the movable amount.

The shielding member 40 may not be integrally formed in a substantially square shape. For example, as long as the transmission characteristics in signal transmission is maintained, the shielding member 40 may be disposed only on the side face of the connector 10 in the left-right direction, or as a separate component, the shielding member 40 may be disposed on each of four side faces of the connector 10 in the front-rear and left-right directions.

The corner 42 may not project to the fitting side with respect to the side face 41. The up-down position of the upper edge of the corner 42 may be substantially the same as the up-down position of the upper edge of the side face 41. Even in this case, the extending portion 43 may extend from the corner 42 of the shielding member 40 to the inside direction that is substantially orthogonal to the fitting direction.

The upper edge of the first insulator 20 may be located below the upper edge of the side face 41 of the shielding member 40. In this case, by bending the upper edge of the side face 41 of the shielding member 40 so that it faces the receiving portion 33 of the second insulator 30, damage such as scraping of the second insulator 30 is suppressed.

Although the contact 50 has been described as being formed of a metal material having a small elastic coefficient, the contact 50 is not limited thereto. The contact 50 may be formed of a metal material having any elastic coefficient as long as the required elastic deformation amount can be secured.

Although the connection object 60 has been described as being a receptacle connector connected to the circuit board CB2, it is not limited thereto. The connection object 60 may be any object other than the connector. For example, the connection object 60 may be an FPC, a flexible flat cable, a rigid board, a card edge of any circuit board, or the like.

The connector 10 as described above is mounted on an electronic device. The electronic device includes, for example, any vehicle-mounted device such as a camera, a radar, a drive recorder, or an engine control unit. The electronic device includes, for example, any in-vehicle device used in an in-vehicle system such as a car navigation system, an advanced driving support system, or a security system. The electronic device includes, for example, any information device such as a personal computer, a copying machine, a printer, a facsimile, or a multifunction peripheral. In addition, the electronic device includes any industrial device.

Such an electronic device can be miniaturized, and the transmission characteristics in signal transmission are improved. Even when the connector 10 is miniaturized, if the connector strength and the workability at the time of fitting are improved, the workability at the time of assembling the electronic device is improved. For example, a favorable floating structure of the connector 10 allows for easy absorption of misalignment between circuit boards. Since the connector 10 suppresses damage to the part connecting with the circuit board CB1, the reliability of the electronic device as a product is improved.

REFERENCE SIGNS LIST

10 Connector
20 First insulator
21 Side wall
22 First regulation portion
23 Second regulation portion
24 Contact mounting groove
25 Protruding wall
30 Second insulator
31 Bottom
32 Side wall
32*a* End face
33 Receiving portion
33*a* Opening
33*b* Corner
33*c* Guide portion
34 Fitting recess
35 Fitting protrusion
36 Contact mounting groove
37 Opening
40 Shielding member
41 Side face
42 Corner
43 Extending portion
44 Bending portion
45 Mounting portion
46 Latch
50 Contact
51 First latch
52 Mounting portion
53*a* First elastic portion
53*b* Second elastic portion
54 Connecting portion
55 Second latch
56 Contact portion
60 Connection object
70 Insulator
71 Fitting recess
72 Guide portion
73 Metal fitting attachment
74 Contact mounting groove
80 Metal fitting
81 Base
82 Mounting portion
83 Latch
90 Contact
91 Latch
92 Mounting portion
93 Elastic contact portion
CB1 Circuit board
CB2 Circuit board

The invention claimed is:

1. A connector configured to be fitted with a connection object, comprising:
a first insulator;
a second insulator movable relative to said first insulator; and
a plurality of contacts each mounted within contact mounting grooves of said first insulator and said second insulator,
wherein said second insulator has a receiving portion that is superimposed on said first insulator from a fitting side in a fitting direction between said connector and said connection object.

2. The connector according to claim 1, wherein said receiving portion is formed over at least a part of an entire circumference of a fitting surface between said connector and said connection object.

3. The connector according to claim 2, wherein said receiving portion is formed along a direction substantially orthogonal to an arrangement direction of said plurality of contacts, and is superimposed on said first insulator in said fitting direction between said connector and said connection object.

4. The connector according to claim 2, wherein said receiving portion is formed along an arrangement direction of said plurality of contacts, and is superimposed on said first insulator in said fitting direction between said connector and said connection object.

5. The connector according to claim 2, wherein a corner of said receiving portion is cut out as viewed from said fitting side between said connector and said connection object.

6. The connector according to claim 1, further comprising a shielding member mounted to said first insulator,
wherein said receiving portion is located closer to said fitting side between said connector and said connection object than an end edge of a side face of said shielding member.

7. The connector according to claim 1, wherein said second insulator is wider on said fitting side between said connector and said connection object than on a side opposite to said fitting side, in an arrangement direction of said plurality of contacts and in a direction substantially orthogonal to said arrangement direction of said contacts.

8. The connector according to claim 1, wherein said receiving portion has a guide portion inclined, from an outside toward an inside, to a side opposite to said fitting side, at an inner edge.

9. An electronic device comprising a connector according to claim 1.

* * * * *